US011289035B2

(12) United States Patent
Ji et al.

(10) Patent No.: US 11,289,035 B2
(45) Date of Patent: Mar. 29, 2022

(54) METHODS FOR OBTAINING BACKLIGHT INTENSITY AND COMPENSATION VALUE, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Zhihua Ji, Beijing (CN); Tiankuo Shi, Beijing (CN); Zhenkun Song, Beijing (CN); Xiaomang Zhang, Beijing (CN); Hsinchung Lo, Beijing (CN); Chingwen Kung, Beijing (CN); Lingyun Shi, Beijing (CN); Xin Duan, Beijing (CN); Yue Li, Beijing (CN); Yifan Hou, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/915,755

(22) Filed: Jun. 29, 2020

(65) Prior Publication Data

US 2020/0410945 A1 Dec. 31, 2020

(30) Foreign Application Priority Data

Jun. 28, 2019 (CN) ..... 201910579331.8

(51) Int. Cl.
*G09G 3/34* (2006.01)
*G09G 3/36* (2006.01)

(52) U.S. Cl.
CPC ..... *G09G 3/3426* (2013.01); *G09G 3/3607* (2013.01); *G09G 2320/066* (2013.01); *G09G 2320/0686* (2013.01); *G09G 2360/16* (2013.01)

(58) Field of Classification Search
CPC ..... G09G 3/34–3426; G09G 3/3607; G09G 2320/06–066; G09G 2320/0686; G09G 2360/16
USPC ..... 345/694
See application file for complete search history.

(56) References Cited

U.S. PATENT DOCUMENTS

2010/0123742 A1* 5/2010 Jang ..... G09G 3/342 345/690
2019/0353961 A1 11/2019 Ji et al.
2019/0355316 A1 11/2019 Ji et al.

FOREIGN PATENT DOCUMENTS

CN 101839423 A 9/2010
CN 108648700 A 10/2018
(Continued)

OTHER PUBLICATIONS

Local Dimming Algorithm for Direct-lit Type LED Backlight in LCD TVs dated Apr. 2015. English abstract provided; 74 pages.
(Continued)

*Primary Examiner* — Amare Mengistu
*Assistant Examiner* — Gloryvid Figueroa-Gibson
(74) *Attorney, Agent, or Firm* — Procopio, Cory, Hargreaves & Savitch LLP

(57) ABSTRACT

A method for obtaining a backlight intensity may improving data processing speed of a display device. The method includes: dividing image data into N sets of data; calculating a backlight intensity of each backlight block according to a corresponding set of data; for each group of pixels, calculating a backlight intensity corresponding to a first pixel
(Continued)

according to a backlight intensity of each effective backlight block corresponding to the first pixel and a backlight diffusion weight of the effective backlight block corresponding to the first pixel; calculating backlight intensities corresponding to second to Mth pixels in the Tth group of pixels according to the backlight intensities corresponding to first pixels in the Tth group of pixels and a (T+1)th group of pixels; and for a Nth group of pixels, setting the backlight intensity corresponding to the first pixel as backlight intensities corresponding to second to Mth pixels.

19 Claims, 18 Drawing Sheets

(56) References Cited

FOREIGN PATENT DOCUMENTS

| | | | |
|---|---|---|---|
| CN | 108665866 | A | 10/2018 |
| CN | 109243384 | A | 1/2019 |
| EP | 3147893 | A1 | 3/2017 |

OTHER PUBLICATIONS

First Office Action for related CN App. No. 201910579331.8 dated May 15, 2020. English translation provided; 29 pages.
Second Office Action for related CN App. No. 201910579331.8 dated Oct. 19, 2020. English translation provided 11 pages.

* cited by examiner

| Horizontal relative distance / Vertical relative distance | 0 | 1 | 2 | 3 | ... | 100 |
|---|---|---|---|---|---|---|
| 0 | 0.99 | 0.96 | 0.94 | 0.92 | ... | 0.03 |
| 1 | 0.96 | 0.94 | 0.92 | 0.9 | ... | 0.02 |
| 2 | 0.94 | 0.92 | 0.9 | 0.88 | ... | 0.02 |
| ... | ... | ... | ... | | ... | ... |
| 100 | 0.03 | 0.03 | 0.02 | 0.02 | ... | 0.01 |

According to:

$$W_e(i, j) = W_a(i, j) - \left[ (W_a(i, j) - W_c(i, j)) \times \frac{dis_v(i)\%step}{step} + 0.5 \right]$$

calculate the second intermediate backlight diffusion weight W_e(i, j) — S1001

According to:

$$W_f(i, j) = W_b(i, j) - \left[ (W_b(i, j) - W_d(i, j)) \times \frac{dis_v(i)\%step}{step} + 0.5 \right]$$

calculate the third intermediate backlight diffusion weight W_f(i, j) — S1002

According to:

$$W(i, j) = W_e(i, j) - \left[ (W_e(i, j) - W_f(i, j)) \times \frac{dis_h(j)\%step}{step} + 0.5 \right]$$

calculate the fourth intermediate backlight diffusion weight W(i, j) — S1003

FIG. 7C

According to:

$$W_e(i, j) = W_a(i, j) - \left[ (W_a(i, j) - W_b(i, j)) \times \frac{dis_h(j)\%step}{step} + 0.5 \right]$$

calculate the second intermediate backlight diffusion weight W_e(i, j)

S1004

According to:

$$W_f(i, j) = W_c(i, j) - \left[ (W_c(i, j) - W_d(i, j)) \times \frac{dis_h(j)\%step}{step} + 0.5 \right]$$

calculate the third intermediate backlight diffusion weight W_f(i, j)

S1005

According to:

$$W(i, j) = W_e(i, j) - \left[ (W_e(i, j) - W_f(i, j)) \times \frac{dis_h(j)\%step}{step} + 0.5 \right]$$

calculate the fourth intermediate backlight diffusion weight W(i, j)

S1006

FIG. 7D

| Initial index value | 0 | 1 | 2 | • • • | 255 |
|---|---|---|---|---|---|
| Backlight intensity | 0 | 1 | 2 | • • • | 255 |
| Compensation weight | 0 | $(255)^{\frac{1}{2.2}}$ | $\left(\frac{255}{2}\right)^{\frac{1}{2.2}}$ | • • • | 1 |

FIG. 12A

| Sampled index value | 0 | • • • | 34 | • • • | 59 |
|---|---|---|---|---|---|
| Compensation weight | 0 | • • • | $\left(\frac{255}{55}\right)^{\frac{1}{2.2}}$ | • • • | 1 |

FIG. 12B

METHODS FOR OBTAINING BACKLIGHT INTENSITY AND COMPENSATION VALUE, AND DISPLAY DEVICE

CROSS-REFERENCE TO RELATED APPLICATION

This application claims priority to Chinese Patent Application No. 201910579331.8 filed on Jun. 28, 2019, which is incorporated herein by reference in its entirety.

TECHNICAL FIELD

The present disclosure relates to the technical field of display, and in particular to methods for obtaining a backlight intensity and a compensation value, and a display device.

BACKGROUND

The liquid crystal display (LCD) device usually includes a display panel and a backlight module for providing backlight for the display panel. In the prior art, the backlight module usually provides uniform backlight, and brightness of the display panel can be adjusted by controlling the deflections of the liquid crystal molecules in the display panel.

With the development of the display technologies, local dimming has been developed and used in the LCD device. By dimming the backlight of regions of the backlight module corresponding to darker positions of an image to be displayed, the power consumption of the backlight module may be reduced and the contrast of the display panel may be improved.

SUMMARY

In one aspect, a method for obtaining a backlight intensity is provided. The method includes: dividing image data of an image to be displayed into N sets of data, each set of data including data of consecutive M image pixels, wherein each set of data corresponds to a respective one of N groups of pixels in a display panel and a respective one of N backlight blocks of a display module, and, wherein N is an integer greater than 1 and M is an integer greater than 1; calculating a backlight intensity of each backlight block according to a corresponding set of data; for each group of pixels, calculating a backlight intensity corresponding to a first pixel in the group of pixels according to a backlight intensity of each effective backlight block corresponding to the first pixel and a backlight diffusion weight of the effective backlight block corresponding to the first pixel, wherein the first pixel is a pixel to which data of a first image pixel in a corresponding set of data is to be input, and, wherein the effective backlight block is a backlight block that is capable of increasing brightness of the first pixel among the N backlight blocks, and, wherein the backlight diffusion weight characterizes a degree of change in brightness of light with distance; for a Tth group of pixels, calculating backlight intensities corresponding to second to Mth pixels in the Tth group of pixels according to the backlight intensity corresponding to the first pixel in the Tth group of pixels and the backlight intensity corresponding to the first pixel in a (T+1)th group of pixels, wherein T is an integer greater than or equal to 1, and less than or equal to (N−1); and for a Nth group of pixels, setting the backlight intensity corresponding to the first pixel in the Nth group of pixels as backlight intensities corresponding to second to Mth pixels in the Nth group of pixels.

In some embodiments, before calculating the backlight intensity corresponding to the first pixel according to the backlight intensity of each effective backlight block corresponding to the first pixel and the backlight diffusion weight of the effective backlight block, the method further includes: performing a downsampling on an initial diffusion weight lookup table according to a preset step size to obtain a sampled diffusion weight lookup table, wherein the initial diffusion weight lookup table includes correspondences between distances from the center of each backlight block to pixels in the display panel covered by light emitted from the backlight block and corresponding backlight diffusion weights, and, wherein each distance includes a horizontal distance and a vertical distance; and obtaining a backlight diffusion weight of each effective backlight block corresponding to the first pixel according to the sampled diffusion weight lookup table.

In some embodiments, obtaining the backlight diffusion weight of each effective backlight block corresponding to the first pixel according to the sampled diffusion weight lookup table, includes: calculating a distance from the center of the effective backlight block to the first pixel; obtaining, according to the distance from the center of the effective backlight block to the first pixel, a plurality of index coordinates corresponding to the effective backlight block, wherein the plurality of index coordinates being capable of indicating of the distance; obtaining, according to the sampled diffusion weight lookup table and the plurality of index coordinates, a first intermediate backlight diffusion weight corresponding to each index coordinate of the effective backlight block; calculating, according to all first intermediate backlight diffusion weights, a fourth intermediate backlight diffusion weight; and setting the fourth intermediate backlight diffusion weight as the backlight diffusion weight of the effective backlight block corresponding to the first pixel.

In some embodiments, obtaining, according to the distance from the center of the effective backlight block to the first pixel, the plurality of index coordinates corresponding to the effective backlight block, includes: calculating four distance values Index_up(i), Index_left(j), Index_down(i) and Index_right(j) according to:

$$\text{Index_left}(j) = \left\lfloor \frac{\text{dis_h}(j)}{\text{step}} \right\rfloor, \text{Index_up}(i) = \left\lfloor \frac{\text{dis_v}(i)}{\text{step}} \right\rfloor, \text{Index_down}(i) = \left\lfloor \frac{\text{dis_v}(i)}{\text{step}} \right\rfloor + 1, \text{ and Index_right}(j) = \left\lfloor \frac{\text{dis_h}(j)}{\text{step}} \right\rfloor + 1,$$

respectively, wherein both i and j are positive integers, and, wherein i and j indicate that the effective backlight block is an effective backlight block in row i and column j, and, wherein dis_v(i) and dis_h(j) represent a vertical distance and a horizontal distance from the center of the effective backlight block in row i and column j to the first pixel, respectively, and, wherein symbol ⌊ ⌋ represents a floor function, and, wherein step represents the preset step size; and generating, according to the four distance values, four index coordinates: (Index_up(i), Index_left(j)), (Index_up(i), Index_right(j)), (Index_down(i), Index_left(j)), and (Index_down(i), Index_right(j)).

In some embodiments, calculating the fourth intermediate backlight diffusion weight includes: calculating a second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_down(i), Index_left(j)); calculating a third intermediate backlight diffusion weight, according to the first intermediate backlight diffusion weight corresponding to the index coordinate (Index_up(i), Index_right(j)) and the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight.

In some embodiments, calculating the second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_down(i), Index_left(j)), includes: calculating the second intermediate backlight diffusion weight W_e(i, j)v according to $$\mathrm{W_e}(i,j) = \mathrm{W_a}(i,j) - \left\lfloor (\mathrm{W_a}(i,j) - \mathrm{W_c}(i,j)) \times \frac{\mathrm{dis_v}(i)\ \%\ \mathrm{step}}{\mathrm{step}} + 0.5 \right\rfloor;$$

calculating the third intermediate backlight diffusion weight, according to the first intermediate backlight diffusion weight corresponding to the index coordinate (Index_up(i), Index_right(j)) and the first intermediate backlight diffusion weight corresponding to the index coordinate (Index_down(i), Index_right(j)), includes: calculating the third intermediate backlight diffusion weight W_f(i, j) according to:

$$\mathrm{W_f}(i,j) = \mathrm{W_b}(i,j) - \left\lfloor (\mathrm{W_b}(i,j) - \mathrm{W_d}(i,j)) \times \frac{\mathrm{dis_v}(i)\ \%\ \mathrm{step}}{\mathrm{step}} + 0.5 \right\rfloor,$$

wherein % represents a remainder operation, and, wherein W_a(i, j) is the first intermediate backlight diffusion weight corresponding to the index coordinate (Index_up(i), Index_left(j)), and, wherein W_b(i, j) is the first intermediate backlight diffusion weight corresponding to the index coordinate (Index_up(i), Index_right(j)), and, wherein W_c(i, j) is the first intermediate backlight diffusion weight corresponding to the index coordinate (Index_down(i), Index_left(j)), and, wherein W_d(i, j) is the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight, includes: calculating the fourth intermediate backlight diffusion weight W(i, j) according to:

$$W(i,j) = \mathrm{W_e}(i,j) - \left\lfloor (\mathrm{W_e}(i,j) - \mathrm{W_f}(i,j)) \times \frac{\mathrm{dis_h}(j)\ \%\ \mathrm{step}}{\mathrm{step}} + 0.5 \right\rfloor.$$

In some embodiments, calculating the backlight intensity corresponding to the first pixel according to the backlight intensity of each effective backlight block corresponding to the first pixel and the backlight diffusion weight of the effective backlight block corresponding to the first pixel, includes: determining a number of effective backlight blocks as a product of k and k; for a first pixel in a Xth group of pixels, calculating a backlight intensity corresponding to the first pixel in the Xth group of pixels according to $$BL_{pix(x,i)} = \sum_{i=1}^{k} \sum_{j=1}^{k} W(i,j) \times BL(i,j),$$

wherein X is an integer greater than or equal to 1 and less than or equal to N, and, wherein k is a positive integer, and, wherein BL(i, j) is a backlight intensity of an effective backlight block in row i and column j, and, wherein $BL_{pix(x,l)}$ is the backlight intensity corresponding to the first pixel in the Xth group of pixels.

In some embodiments, calculating the backlight intensities corresponding to second to Mth pixels in the Tth group of pixels according to the backlight intensity corresponding to the first pixel in the Tth group of pixels and the backlight intensity corresponding to the first pixel in the (T+1)th group of pixels, includes: calculating a backlight intensity corresponding to a Pth pixel in the Tth group of pixels according to $$BL_{pix(t,p)} = BL_{pix(t,1)} + \left\lfloor (BL_{pix(t+1,1)} - BL_{pix(t,1)}) \times \frac{P-1}{M} + 0.5 \right\rfloor;$$

wherein P is an integer greater than or equal to 2, and less than or equal to M, and, wherein $BL_{pix(t,p)}$ is the backlight intensity corresponding to the Pth pixel in the Tth group of pixels, and, wherein $BL_{pix(t,1)}$ is the backlight intensity corresponding to the first pixel in the Tth group of pixels, and, wherein $BL_{pix(t+1,1)}$ is the backlight intensity corresponding to the first pixel in the (T+1)th group of pixels.

In some embodiments, calculating, according to the first intermediate backlight diffusion weight, the fourth intermediate backlight diffusion weight, includes: calculating a second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_up(i), Index_right(j)); calculating a third intermediate backlight diffusion weight, according to the first intermediate backlight diffusion weight corresponding to the index coordinate (Index_down(i), Index_left(j)) and the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight.

In some embodiments, calculating the second intermediate backlight diffusion weight, according to the first intermediate backlight diffusion weight corresponding to an index coordinate (Index_up(i), Index_left(j)) and the first intermediate backlight diffusion weight corresponding to an index coordinate (Index_up(i), Index_right(j)), includes: calculating the second intermediate backlight diffusion weight W_e(i, j) according to $$\mathrm{W_e}(i,j) = \mathrm{W_a}(i,j) - \left\lfloor (\mathrm{W_a}(i,j) - \mathrm{W_b}(i,j)) \times \frac{\mathrm{dis_h}(j)\ \%\ \mathrm{step}}{\mathrm{step}} + 0.5 \right\rfloor;$$

calculating the third intermediate backlight diffusion weight, according to the first intermediate backlight diffusion weight corresponding to an index coordinate (Index_down(i), lndex_left(j)) and the first intermediate backlight diffusion weight corresponding to an index coordinate (Index_down (i), Index_right(j)), includes: calculating the third intermediate backlight diffusion weight W_f(i, j) according to $$\mathrm{W_f}(i,j)=\mathrm{W_c}(i,j)-\left\lfloor(\mathrm{W_c}(i,j)-\mathrm{W_d}(i,j))\times\frac{\mathrm{dis_h}(j)\ \%\ \mathrm{step}}{\mathrm{step}}+0.5\right\rfloor;$$

and calculating the fourth intermediate backlight diffusion weigh, according to the second intermediate backlight diffusion weight and the third intermediate backlight diffusion weight, t, includes: calculating the fourth intermediate backlight diffusion weight W(i, j) according to $$W(i,j)=\mathrm{W_c}(i,j)-\left\lfloor(\mathrm{W_e}(i,j)-\mathrm{W_f}(i,j))\times\frac{\mathrm{dis_v}(i)\ \%\ \mathrm{step}}{\mathrm{step}}+0.5\right\rfloor.$$

after calculating the backlight intensity corresponding to the first pixel according to the backlight intensity of each effective backlight block corresponding to the first pixel and the backlight diffusion weight of the effective backlight block corresponding to the first pixel, the method further includes: reading a reference backlight diffusion weight of each effective backlight block corresponding to the first pixel from the initial diffusion weight lookup table; calculating a reference backlight intensity corresponding to the first pixel according to the backlight intensity of each effective backlight block and the reference backlight diffusion weight of the effective backlight block corresponding to the first pixel; determining whether a difference between the reference backlight intensity corresponding to the first pixel and the backlight intensity corresponding to the first pixel is less than or equal to a preset threshold; and in response to determining that the difference is not less than or equal to the preset threshold, adjusting the preset step size until the difference between the reference backlight intensity corresponding to the first pixel and the backlight intensity corresponding to the first pixel is less than or equal to the preset threshold.

In another aspect, a method for obtaining a compensation value is provided. The method includes: obtaining a backlight intensity corresponding to each pixel by using the method for obtaining the backlight intensity described above; performing a stratified downsampling on an initial compensation weight lookup table to obtain a sampled compensation weight lookup table, wherein the initial compensation weight lookup table includes correspondences among a plurality of initial index values, a plurality of backlight intensities and a plurality of compensation weights, and, wherein the initial index values are equal to their corresponding backlight intensities; obtaining a compensation weight corresponding to each pixel according to the sampled compensation weight lookup table; and calculating a compensation value corresponding to each pixel, according to the compensation weight corresponding to the pixel and three primary color components in data of an image pixel corresponding to the pixel.

In some embodiments, performing the stratified downsampling on the initial compensation weight lookup table to obtain the sampled compensation weight lookup table includes: obtaining correspondences between a plurality of sampled index values and the plurality of initial index values according to $$\begin{cases}0\le Y\le 27,\ F(Y)=Y\\ 27<Y\le 34,\ F(Y)=4\times(Y-27)+27\\ 34<Y\le 59,\ F(Y)=8\times(Y-34)+55\end{cases},$$

wherein F(Y) is the initial index value and Y is the sampled index value; and performing a stratified downsampling on the initial compensation weight lookup table according to the correspondences between the plurality of sampled index values and the plurality of initial index values to obtain the sampled compensation weight lookup table.

In some embodiments, obtaining the compensation weight corresponding to each pixel according to the sampled diffusion weight lookup table, includes: for the backlight intensity $BL_{pix}$ corresponding to the pixel: determining which range the $BL_{pix}$ belongs to; in response to determining that $BL_{pix}$ is greater than or equal to 0 and less than or equal to 27: setting Y as $BL_{pix}$, and calculating the compensation weight $W_BL_{pix}$ corresponding to the pixel according to $W_BL_{pix}=W(Y)$, wherein W(Y) is the compensation weight corresponding to the sampled index value Y in the sampled compensation weight lookup table; in response to determining that the $BL_{pix}$ is greater than 27 and less than or equal to 55: setting Y and Mod as $$Y=27+\left\lfloor\frac{(BL_{pix}-27)}{4}\right\rfloor$$

and Mod=$(BL_{pix}-27)\%4$ respectively, and calculating the compensation weight $W_BL_{pix}$ corresponding to the pixel according to WL=W(Y), WR=W(Y+1), $$\mathrm{W_BL}_{pix}=WL-\left\lfloor\frac{(WL-WR)\times\mathrm{Mod}}{4}+0.5\right\rfloor;$$

in response to determining that the $BL_{pix}$ is greater than 55 and less than or equal to 255: setting Y and Mod as $$Y=34+\left\lfloor\frac{(BL_{pix}-55)}{8}\right\rfloor$$

and Mod=$(BL_{pix}-55)\%8$ respectively, and calculating the compensation weight $W_BL_{pix}$ corresponding to the pixel according to WL=W(Y), WR=W(Y+1), $$\mathrm{W_BL}_{pix}=WL-\left\lfloor\frac{(WL-WR)\times\mathrm{Mod}}{8}+0.5\right\rfloor,$$

wherein % represents a remainder operation, symbol ⌊ ⌋ represents a floor operation; W(Y+1) is a compensation weight corresponding to a sampled index value (Y+1) in the sampled compensation weight lookup table, and $W_BL_{pix}$ is a compensation weight corresponding to a pixel having a backlight intensity of $BL_{pix}$.

In some embodiments, calculating the compensation value corresponding to each pixel according to the compensation weight corresponding to the pixel and the three primary color components in data of an image pixel corresponding to the pixel, includes: for each pixel: calculating a product of a red brightness value R and the compensation weight $W_BL_{pix}$ corresponding to the pixel as a red brightness compensation value R', calculating a product of a green brightness value G and the compensation weight corresponding to the pixel as a green brightness compensation value G', and calculating a product of a blue brightness value B and the compensation weight $W_BL_{pix}$ corresponding to the pixel as a blue brightness compensation value B'.

In yet another aspect, a non-transitory computer readable storage medium is provides. The non-transitory computer readable storage medium stores computer programs that, when executed by a processor, perform the method for obtaining the backlight intensity described above.

In yet another aspect, a non-transitory computer readable storage medium is provides. The non-transitory computer readable storage medium stores computer programs that, when executed by a processor, perform the method for obtaining the compensation value of the backlight described above.

In yet another aspect, a display device is provided. The display device includes a display panel a backlight module, a memory storing computer programs and a processor. The processor configured to execute the computer programs to perform the method for obtaining the backlight intensity described above.

In yet another aspect, a display device is provided. The display device includes a display panel a backlight module, a memory storing computer programs and a processor. The processor configured to execute the computer programs to perform the method for obtaining the compensation value of the backlight described above.

BRIEF DESCRIPTION OF THE DRAWINGS

To describe the technical solutions of the embodiments of the present disclosure more clearly, drawings to be used in some embodiments of the present disclosure will be introduced simply. However, the drawings to be described below are merely drawings for some embodiments of the present disclosure. For a person of ordinary skill in the art, other drawings may be obtained according to those drawings. Additionally, the drawings to be described below may be considered as schematic views and are not intended to limit the actual size of products, the actual flow of the method, and the actual timing sequence of signals involved in embodiments of the present disclosure.

FIG. 7C is a flowchart of yet another method for obtaining the backlight intensity, in accordance with some embodiments;

FIG. 7D is a flowchart of yet another method for obtaining the backlight intensity, in accordance with some embodiments;

FIG. 12A is a schematic diagram of an initial compensation weight lookup table, in accordance with some embodiments;

FIG. 12B is a schematic diagram of a sampled compensation weight lookup table, in accordance with some embodiments;

DETAILED DESCRIPTION

Figure 1A:
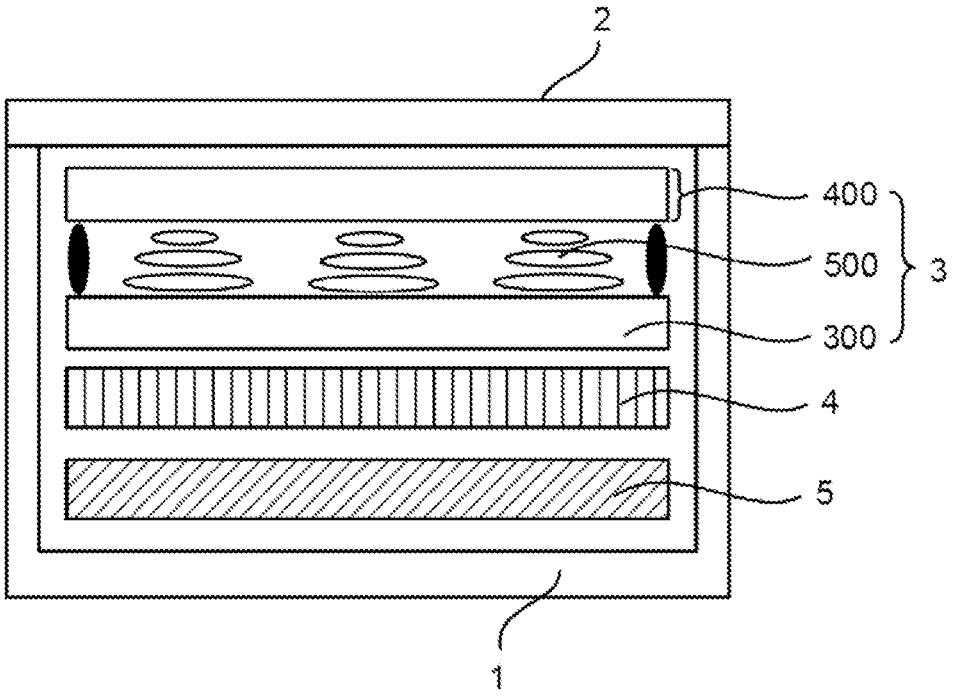
FIG. 1A is a schematic diagram of a liquid crystal display (LCD) device, in accordance with some embodiments.

The technical solutions in some embodiments of the present disclosure will be described clearly and completely with reference to the accompanying drawings. However, the embodiments to be described are merely some embodiments of the present disclosure rather than all embodiments. All other embodiments obtained by a person of ordinary skill in the art on the basis of embodiments provided in the present disclosure are within the protection scope of the present disclosure.

Unless the context requires otherwise, the term "comprise", and other forms thereof such as the third-person singular form "comprises" and the present participle form "comprising" in the description and the claims are construed as an open and inclusive meaning, i.e., "included, but not limited to". In the description, terms such as "one embodiment", "some embodiments", "exemplary embodiments", "example", "some examples", or "specific example" are intended to indicate that specific features, structures, materials or characteristics related to the embodiment(s) or the example(s) are included in at least one embodiment or example of the present disclosure. Schematic representations of the above terms do not necessarily refer to the same embodiment(s) or example(s). In addition, the specific features, structures, materials or characteristics may be included in any or more embodiments/examples in any suitable manner.

Terms such as "first" and "second" are used for descriptive purposes only, and are not to be construed as indicating or implying the relative importance or implicitly indicating the number of indicated technical features. Thus, features defined by "first" and "second" may explicitly or implicitly include one or more of the features. In the description of the embodiments of the present disclosure, a term "a plurality of" means two or more unless otherwise specified.

It will be understood that when a device, component or the like is referred to as being "configured to do something", it construed as an open and inclusive meaning, and does not exclude the device, component or the like are configured to perform additional tasks or steps.

It will also be understood that when a layer or element is referred to as being "on" another layer, element or substrate, it can be directly on the other layer or substrate, or intervening layers may also be present. Further, it will be understood that when a layer or an element is referred to as being "under" another layer or element, it can be directly under, and one or more intervening layers may also be present. In addition, it will also be understood that when a layer or element is referred to as being "between" two layers, it can be the only layer or element between the two layers or two elements, or one or more intervening layers or elements may also be present. Like reference numerals refer to like elements throughout.

As shown in FIG. 1A, the liquid crystal display device includes a framework 1, cover glass 2, a display panel 3, a backlight module 4, a circuit board 5 and other electronic accessories. The framework 1 has a U-shaped longitudinal section. The display panel 3, the backlight module 4, the circuit board 5 and the other electronic accessories are disposed in the framework 1. The backlight module 4 is disposed under the display panel 3, the circuit board 5 is disposed under the backlight module 4, and the cover glass 2 is disposed on a side of the display panel 3 away from the backlight module 4.

The display panel 3 includes an array substrate 300, an opposite substrate 400, and a liquid crystal layer 500 disposed between the array substrate 300 and the opposite substrate 400. For example, the array substrate 300 and the opposite substrate 400 may be joined together by a sealant, so that liquid crystal molecules in the liquid crystal layer 500 are limited in a space enclosed by the sealant.

The circuit board 5 is configured to provide the display panel 3 with signals required for display. For example, the circuit board 5 is a printed circuit board assembly (PCBA). The PCBA may include a printed circuit board (PCB), and integrated circuits (ICs) or circuits such as a timing controller (TCON) and a power management IC (PMIC) disposed on the PCB.

Figure 1B:
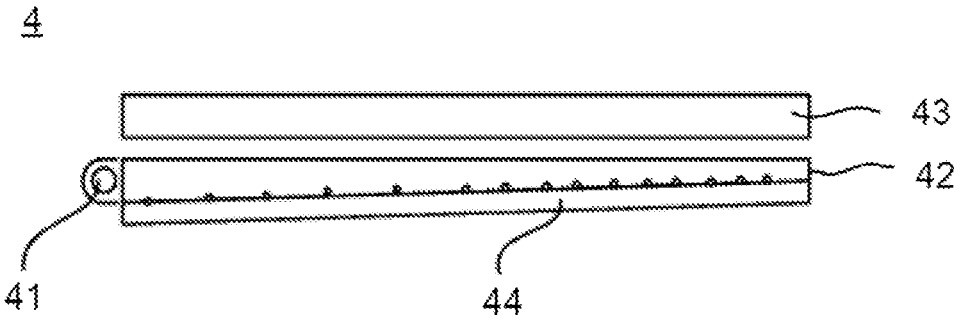
FIG. 1B (Prior Art)
FIG. 1B is a schematic diagram showing a structure of a backlight module, in accordance with the related art.
Figure 1C:
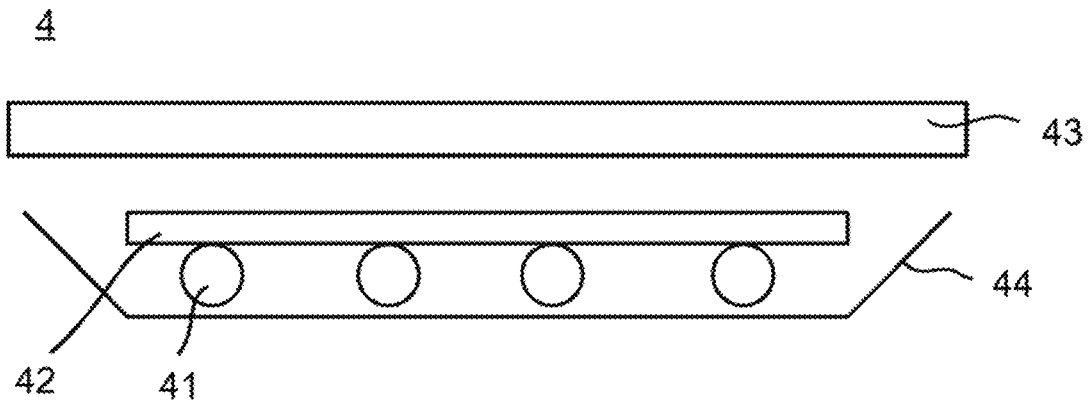
FIG. 1C is a schematic diagram showing a structure of another backlight module, in accordance with some embodiments.

As shown in FIGS. 1B and 1C, the backlight module 4 includes a light guide plate 42, a backlight 41 disposed at a light inlet side of the light guide plate 42, and at least one optical film 43 disposed on a light outlet side of the light guide plate 42. FIG. 1B shows the light guide plate 42 having a wedge-shaped cross section, and FIG. 1C shows a flat light guide plate 42. The at least one optical film 43 includes, for example, a diffuser and/or at least one brightness enhanced film (BEF). The at least one brightness enhanced film includes, for example, a prism sheet and a double brightness enhancement film (DBEF).

The backlight 41 includes, for example, light-emitting diodes (LEDs). As shown in FIG. 1B, the backlight 41 may be disposed along an edge of the light guide plate 42. In this case, the backlight module 4 is an edge-lit backlight module. As shown in FIG. 1C, the backlight 41 may be disposed on a side of the light guide plate 42 away from the light outlet side. In this case, the backlight module 4 is a back-lit backlight module. The backlight modules 4 in FIGS. 1B and 1C are merely exemplary, but the backlight module 4 is not limited thereto.

Furthermore, as shown in FIGS. 1B and 1C, the backlight module 4 may further include a reflector 44. For the edge-lit backlight module, the reflector 44 is disposed on a side of the light guide plate 42 away from the light outlet side. For the back-lit backlight module, the reflector 44 is disposed on a side of the backlight 41 away from the light guide plate 42.

In the related art, when the liquid crystal display device displays images, the brightness of the backlight 41 does not change, and a degree of deflection of the liquid crystal molecules in the liquid crystal layer 500 may be changed to adjust the brightness of the images. However, this may result in a low contrast of the images. Besides, the backlight 41 is always in a turned-on state and its whole brightness may remain unchanged during the display, resulting in high power consumption.

With developments of display technology, dynamic dimming technology has been developed and adopted. The dynamic dimming is to dynamically adjust a backlight intensity (or intensities) of the backlight module 4 according to the image to be displayed. The luminous intensity or the brightness value of the backlight module 4 may be related with the data of image pixels in the image to be displayed. For example, if a grayscale value of an image pixel in the image to be displayed is 75, then the brightness value of the pixel in the display panel corresponding to this image pixel is 75. In this case, the backlight intensity corresponding to this pixel in the display panel 3 may be set according to the brightness value of the pixel.

It will be noted that the pixel in the display panel 3 and the image pixel in the image to be displayed are different concepts. The image pixel refers to a smallest unit that constitutes an image, while the pixel in the display panel 3 is the smallest physical unit used for display 3. The pixel may include a red sub-pixel, a green sub-pixel and a blue sub-pixel.

The dynamic dimming mainly includes global dimming and local dimming. In the global dimming, a backlight intensity of the backlight module 4 is determined by calculating an average grayscale value of an image to be displayed. The backlight intensities of different regions of the backlight module 4 may be the same, and the brightness of the backlight module 4 may be substantially even. That "backlight intensity" herein and hereinafter may refer to a luminous intensity of the backlight module 4, or refer to a brightness value of the backlight module 4.

The backlight intensity may range from 0 to 255 level (that is, there exists 256 backlight intensities), which may consistent with 256 levels of gray scale value of the image pixels.

Figure 2:
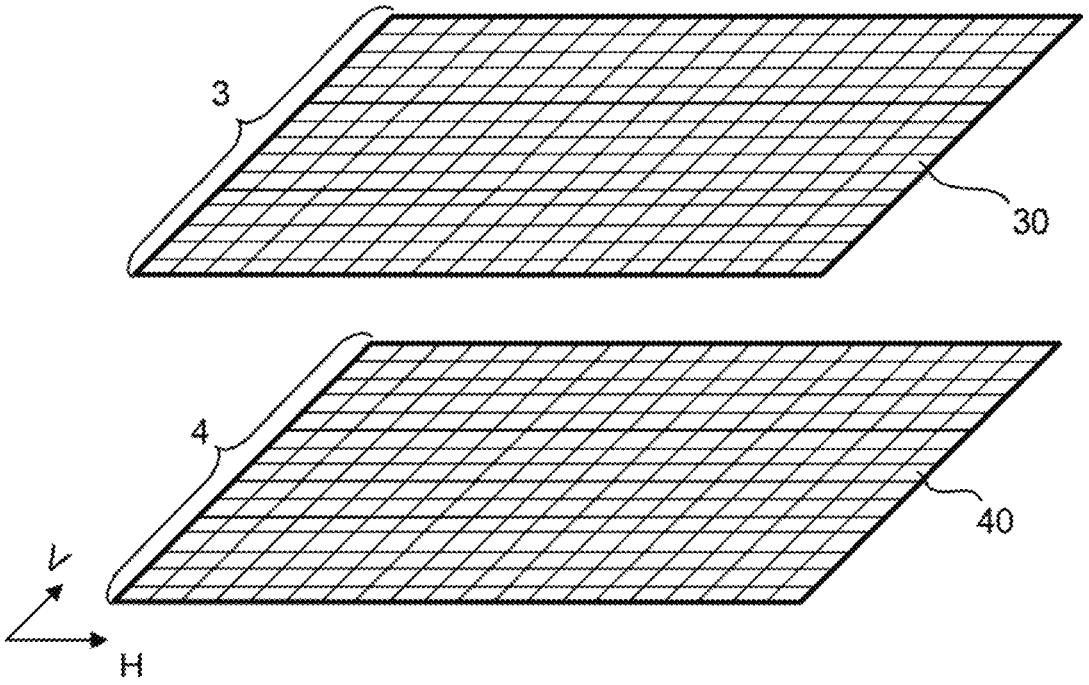
FIG. 2 is a schematic diagram showing a correspondence between a display panel and a backlight module, in accordance with some embodiments.

In the local dimming, as shown in FIG. 2, the backlight module 4 includes a plurality of backlight blocks 40. Each backlight block 40 corresponds to or includes one or more backlights, and the backlight intensity of each backlight block 40 may be independently adjusted.

For example, the backlight module 4 includes N backlight blocks 40, where N is an integer greater than 1. Each backlight block 40 corresponds to a group of pixels in the display panel 3. In other words, the orthographic projection of the group of pixels on the backlight module 4 and the backlight block 40 substantially coincide. The way to obtain the backlight intensity of a backlight block 40 may be as follows. The image data of an image to be displayed is divided into N sets of data; an average grayscale value is obtained according to a corresponding set of data; and the backlight intensity of the backlight block 40 is calculated according to the average gray value. The backlight intensity is used as a backlight intensity to be input to the backlight block 40. In this case, in an image frame, the brightness of each backlight block 40 may be individually adjusted, and the brightness of different backlight blocks 40 of the backlight module 4 may be different to improve the contrast of the display panel 3.

For example, the brightness of a region of the backlight 41 corresponding to a dark area of the image frame to be displayed may be adjusted to be lower, and the brightness of a region of the backlight 41 corresponding to a bright area of the image frame to be displayed may be adjusted to be higher. In this way, the power consumption of the backlight module 4 may be reduced and the contrast of the image frame may be improved.

For example, the local dimming may be applied to the back-lit backlight module which includes a plurality of LEDs evenly distributed. Of course, the local dimming may also be applied to backlight modules of other types.

The embodiments of the present disclosure will be described on a basis of the local dimming.

For example, as shown in FIG. 2, the display panel 3 includes a plurality of display blocks 30, and each display block 30 includes a group of pixels. In a thickness direction of the display panel 3, each display block 30 corresponds to a respective one of the plurality of backlight blocks 40. In other words, an orthographic projection of each backlight block 40 on the display panel 3 and a corresponding display block 30 substantially coincide. According to the plurality of display blocks 30 and the plurality of backlight blocks 40, the image data of the image to be displayed is divided into a plurality of sets of data, and during the display of the image, each set of data is input to a group of pixels in a corresponding display block 30 and a corresponding backlight block 40. On this basis, the backlight intensity obtained according to the set of data in the image to be displayed is used as the backlight intensity of the backlight block 40 corresponding to the display block 30.

It will be noted that boundaries of the backlight blocks 40 and the display blocks 30 defined by the straight lines in FIG. 2 are virtual boundaries, and actually, the straight lines do not exist in the display panel 3 and the backlight module 4. The number of the plurality of display blocks 30 in the display panel 3 may be set according to actual needs.

For example, as shown in FIG. 2, the backlight module 4 is divided into an array of 300 (20×15) backlight blocks 40. The array includes 20 column in a horizontal direction H, and 15 rows in a vertical direction V. The display panel 3 is divided into 300 (20×15) display blocks 30. Each display blocks 30 corresponds to a respective one of the 300 backlight blocks 40. On this basis, according to the 300 display blocks 30, the image data of the image to be displayed is divided into 300 (20×15) sets of data. Each set of data corresponds to a respective one of the display blocks 30. In other words, when the image is displayed, each set of data is transmitted to pixels in a corresponding display blocks 30.

For example, the resolution of the display panel 3 is 4800×3600, and each display block 30 includes 240×240 pixels. Each set of data may include data of 240×240 image pixels. During the image display, the data of the 240×240 image pixels in the set of data is input to 240×240 pixels in a corresponding display block 30 of the display panel 3, so that a portion of the image is displayed on the display block 30 (the portion of the image may be called as an image block).

On this basis, three primary color components in data of each image pixel in each set of data are counted, and a maximum value of the grayscale values of all image pixels in each set of data is determined through, for example, a maximum value method. Then, the maximum value is used as the backlight intensity of the corresponding backlight block 40. It can be understood that, the brightness of each backlight block 40 can be adjusted by controlling magnitudes of driving currents of the backlight 41 in each backlight block 40.

The maximum value method includes the following steps. For each set of data, a maximum value of the grayscale values of the three primary color components in data of each image pixel is obtained, and is used as the grayscale value of the image pixel; and a maximum grayscale value is selected among grayscale values of all the image pixels, and is used as the backlight intensity of the backlight block 40 corresponding to the set of data.

The three primary colors include, for example, red, green and blue. That is, $I(x,y)=\max(R(x,y),G(x,y),B(x,y))$. Here, $R(x,y)$, $G(x,y)$, $B(x,y)$ are the grayscale values of the three primary color components in the data of the image pixel in row x and column y, $I(x,y)$ is the grayscale value of the image pixel in row x and column y, and both x and y are positive integers.

On this basis, in an ideal state, each backlight block 40 can individually illuminate its corresponding display block 30. But in fact, due to diffusion of light, brightness of each display block 30 will be affected by nearby backlight blocks 40.

When part of the backlight 41 in one backlight block 40 is turned on, the diffusion range of light emitted from the backlight block 40 may be larger than the display block 30 corresponding to the backlight block 40, and the light may diffuse to a plurality of adjacent display blocks 30. With the brightest spot in the turned-on backlight block 40 regarded as a center, the diffusion range of the light can covers tens to hundreds of pixels, and the region of the display panel 30 covered by the light emitted from the backlight block 40 may be called as a backlight diffusion region of the backlight block 40.

Normally, the diffusion of light is isotropic, and thus an orthographic projection of the backlight diffusion region on the display panel 3 is substantially circular.

Figures 3A, 3B:
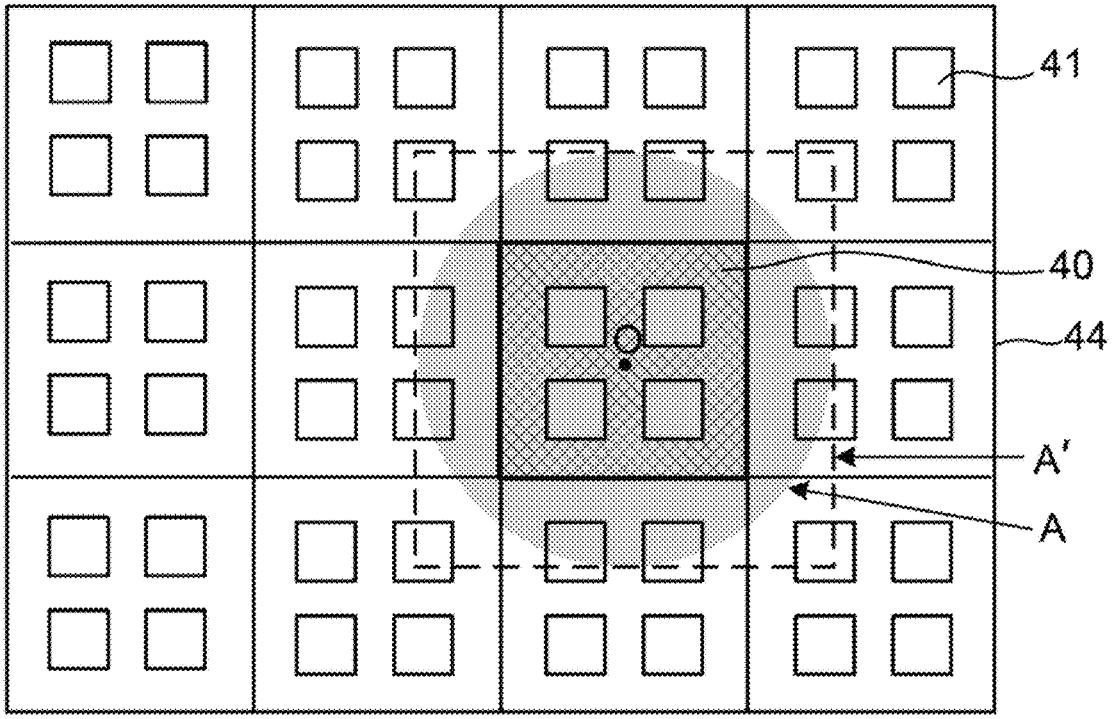
FIG. 3A is a top view showing effective backlight blocks of a backlight module, in accordance with some embodiments.
FIG. 3B is a schematic diagram of an initial diffusion weight lookup table, in accordance with some embodiments.

For example, as shown in FIG. 3A, the backlight block 40 located in row 2 and column 3 is turned on and centered on a point O, and the backlight diffusion region of the backlight block 40 is represented by a region A.

On this basis, the brightness of all pixels of the backlight diffusion region and the distances between the pixels and the center of the backlight block 40 are fitted to obtain a point spread function (PSF). Then, according to the point spread function, a backlight diffusion weight from the center O of the backlight block 40 to each pixel in the backlight diffusion region A can be calculated, so that an initial diffusion weight lookup table is generated. The initial diffusion weight lookup table includes a correspondence between a distance from the center O of the backlight block 40 to each pixel in the backlight diffusion region A and a corresponding backlight diffusion weight.

Here, the center O of the backlight block 40 refers to a geometric center of the backlight block 40. The backlight diffusion weight may characterize a degree of change in brightness of light with distance.

As shown in FIG. 3A, the distance from the center O of the backlight block 40 to each pixel in the backlight diffusion region A may be expressed by the number of pixels located between the center O of the backlight block 40 and the pixel. It will be noted that the distance from the center O of the backlight block 40 to each pixel includes a vertical distance and a horizontal distance. The horizontal distance is the number of pixels between the center O of the backlight block 40 and the pixel in a horizontal direction, and the vertical distance is the number of pixels between the center O of the backlight block 40 and the pixel in a vertical direction. A plane where the horizontal direction and the vertical direction are located is substantially parallel to the display surface of the display panel 30.

It will be noted that, in addition to the point spread function, the backlight diffusion weight from the center O of the backlight block 40 to each pixel in the backlight diffusion region A may be calculated by other fitting functions.

In addition, the backlight diffusion region used to generate the initial diffusion weight lookup table is set to be larger than the actual backlight diffusion region. For example, the actual backlight diffusion region A is the circle as shown in FIG. 3A. However, the region used to generate the initial diffusion weight lookup table is a circumscribed square (for example, the region A' in FIG. 3A) of the backlight diffusion region A.

Taking a square area containing 200×200 pixels, which is used to generate the initial diffusion weight lookup table, as an example, since the diffusion of light is isotropic and the square is axisymmetric, as shown in FIG. 3B, an initial diffusion weight lookup table containing 100×100 correspondences may be generated. Each correspondence is a correspondence among a horizontal distance, a vertical distance and a backlight diffusion weight.

For example, for a backlight block 40, in the horizontal direction, there are three pixels located between a pixel in the backlight diffusion region A' and the center of the backlight block 40, and in the vertical direction, there are two pixels between the pixel in the backlight diffusion region A' and the center of the backlight block 40. In this case, the horizontal distance from the center of the backlight block 40 to the pixel is 3, and the vertical distance is 2. In addition, the backlight diffusion weight corresponding to the pixel may be calculated according to the point diffusion function. As shown in FIG. 3B, the backlight diffusion weight corresponding to this distance may be found at a position of (3, 2) in the initial diffusion weight lookup table, that is 0.88.

It will be noted that, for all backlight blocks 40 in the liquid crystal display device, a same point spread function may be applied, that is, a same initial diffusion weight lookup table may be applied to the all backlight blocks 40.

When the liquid crystal display device displays an image, a pixel in the display panel 3 may be affected by the diffusion of light emitted from multiple backlight blocks 40. In other words, the pixel is within backlight diffusion regions of the multiple backlight blocks 40. The backlight blocks 40 that affect the pixel are called effective backlight blocks of the pixel.

It will be noted that once the distance between the pixel and each effective backlight block is determined, the backlight diffusion weight of each effective backlight block corresponding to the pixel may be obtained by looking up the initial diffusion weight lookup table. In this way, if the distance of the pixel and each effective backlight block is determined, backlight diffusion weights of the effective backlight blocks corresponding to the pixel may be obtained by looking up the initial diffusion weight lookup table for multiple times.

On the basis of the initial diffusion weight lookup table, a product of the backlight diffusion weight of each effective backlight block corresponding to the pixel and the backlight intensity of the effective backlight block may be calculated, and then a sum of all products may be calculated to obtain the backlight intensity corresponding to the pixel.

For example, an A pixel is affected by light emitted from effective backlight blocks of 5 rows×5 columns (total 25). By calculation, the backlight intensity $BL_{(I,1)}$ of the effective backlight block in row 1 and column 1 is obtained. By looking up the initial diffusion weight lookup table, the backlight diffusion weight $W_{(1,1)}$ of the effective backlight block corresponding to the pixel A is obtained. Similarly, the backlight intensity $W_{(1,2)}$ of the effective backlight block in row 1 and column 2 is calculated, and the backlight diffusion weight $W_{(1,2)}$ of the effective backlight block corresponding to the A pixel can also be obtained. In this way, the backlight intensities and backlight diffusion weights corresponding to the 25 effective backlight blocks are all obtained. Then, according to $$BL_{A_ori} = \sum_{i=1}^{5}\sum_{j=1}^{5} BL_{(ij)} \times W_{(ij)},$$

the backlight intensity $BL_{A_ori}$ corresponding to the pixel A is obtained.

However, since it is necessary to look up the initial diffusion weight lookup table once for a backlight diffusion weight of each effective backlight block, when there are many effective backlight blocks for the pixel, multiple times of lookups are required, which may be time-consuming.

In some embodiments of the present disclosure, a method for obtaining a backlight intensity is provided. The backlight intensity is a backlight intensity corresponding to any pixel in the display panel 3.

It will be noted that all methods described herein may be performed by one or more processors in the display device. The one or more processors may refer to, be part of, or include an application specific integrated circuit (ASIC); an electronic circuit; a combinational logic circuit; a field programmable gate array (FPGA); a processor (shared, dedicated, or group) that executes code; other suitable hardware components that provide the described functionality; a combination of some or all of the above, such as in a system-on-chip; or the timing controller (ICON).

Figure 4A:
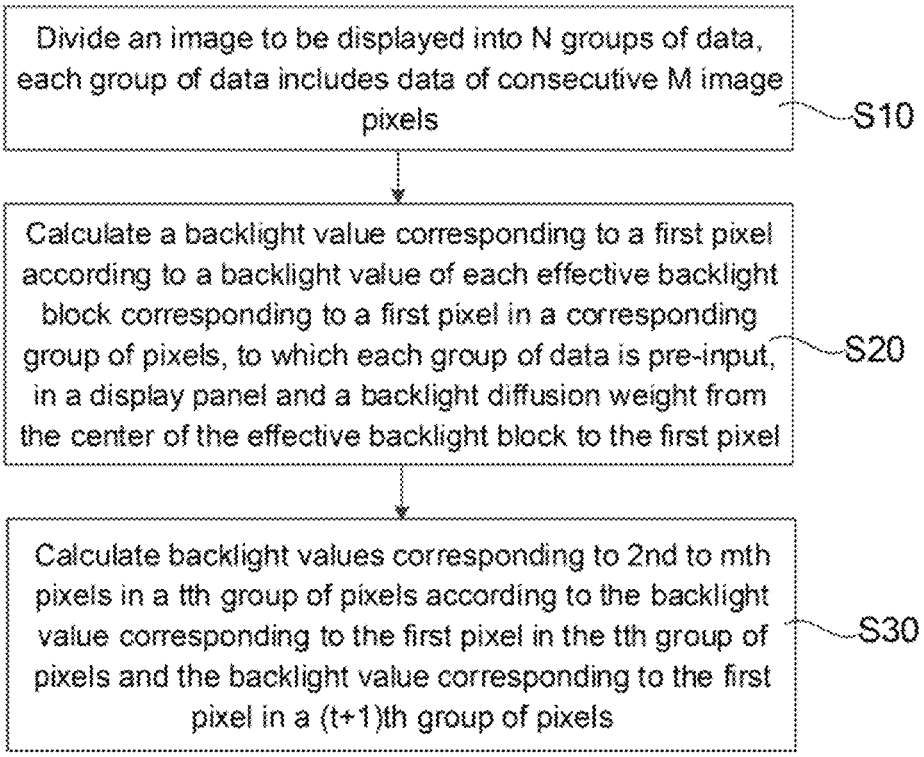
FIG. 4A is a flowchart of a method for obtaining a backlight intensity, in accordance with some embodiments.

As shown in FIG. 4A, the method includes the following S10 to S30.

In S10, image data of an image to be displayed is divided into N sets of data, and a backlight intensity of each backlight block 40 is calculated according to a corresponding set of data. Each set of data includes data of consecutive M image pixels. N is an integer greater than 1, and M is an integer greater than 1.

The display panel 3 may be divided into N display blocks 30, and all pixels in each display block 30 constitute a group of pixels. On this basis, the image data of the image to be displayed is divided into N sets of data. Each set of data corresponds to a group of pixels and a backlight block 40.

The backlight intensity of the backlight block 40 may be calculated according to the set of data by using the above-mentioned maximum value method, or may be calculated by some other methods.

During the image display, the N sets of data are input into N groups of pixels of the display panel 3 and N backlight blocks 40, and each set of data is input into a corresponding group of pixels and a corresponding backlight block 40. For the each group of pixels, data of an image pixel included in corresponding set of data is input to a corresponding pixel in the group of pixels and a corresponding backlight block 40.

During the display of the display device, the host driver sends image data of an image to be displayed and a plurality of timing signals to the field programmable gate array (FPGA) via, for example, a low voltage differential signaling (LVDS) interface. For example, the host driver sends N sets of data sequentially under control of S clock signals, wherein S is a positive integer less than or equal to N. The FPGA receives and processes the image data, and then sends the processed data to the timing controller (ICON) and the backlight driver circuit to control the display panel 3 and the backlight module 4, respectively. The FPGA includes a plurality of gate array logic circuits, and the gate array logic circuits include thousands of logic elements that can realize various functions through programming.

It will be noted that, S may be equal to N, that is, the host driver may send a set of data under control of a clock signal, which makes it convenient to calculate the data.

For example, the data of every 6 image pixels in the image to be displayed constitute a set of data. If there are 1000 sets of data in the image to be displayed, the host driver may send the data of 6 image pixels in a set of data under control of a clock signal. In this way, the host driver sends the 1000 sets of data sequentially in response to 1000 clock signals, and the image is displayed by the 1000 groups of pixels of the display panel.

For example, the host driver may send the image data of the image to be displayed to the TCON or a system-on-a-chip (SoC) sequentially, and then the TCON or SoC processes the image data, and sends the processed data to the display panel 3 and the backlight module 4.

In S20, for each group of pixels, a backlight intensity corresponding to a first pixel in the group of pixels is calculated according to a backlight intensity of each effective backlight block corresponding to the first pixel, and a backlight diffusion weight of the effective backlight block corresponding to the first pixel.

The first pixel is a pixel, to which data of a first image pixel in the set of data is to be input, in the display panel 3. The effective backlight block is a backlight block 40 that is capable of enhancing brightness of the first pixel among the N backlight blocks 40. The backlight diffusion weight characterizes a degree of change in brightness of light (emitted from the backlight block 40) with distance.

The backlight intensity corresponding to the first pixel refers to, for example, the total backlight intensities of the backlight blocks 40 that affects brightness of the first pixel among the N backlight blocks 40. Here, that "the backlight block 40 affects brightness of the first pixel" means that the backlight diffusion region of the backlight block 40 will cover the first pixel, so that light emitted from the backlight block 40 can affect the brightness of the first pixel.

In S30, for a Tth group of pixels, backlight intensities corresponding to second to Mth pixels in the Tth group of pixels are calculated according to the backlight intensity corresponding to the first pixel in the Tth group of pixels and the backlight intensity corresponding to the first pixel in a (T+1)th group of pixels, wherein T is an integer that is greater than or equal to 1 and less than or equal to (N−1) (i.e., $N-1 \geq t \geq 1$); for a Nth group of pixels, the backlight intensity corresponding to the first pixel in the Nth group of pixels is set as backlight intensities corresponding to second to Mth pixels in the Nth group of pixels.

During diffusion of light, the light intensity decreases as the diffusion distance increases. Since there is only a small distance between two adjacent pixels in the display panel 3, the difference in the intensity of light received by the two adjacent pixels may not be large. Therefore, backlight intensities corresponding to second to Mth pixels in the Tth group of pixels may be calculated according to the backlight intensity corresponding to the first pixel in the Tth group of pixels and the backlight intensity corresponding to the first pixel in the (T+1)th group of pixels, thereby reducing the difficulty of the calculation and improving the efficiency of the calculation.

In the above method, a backlight intensity corresponding to each first pixel in the N groups of pixels are calculated according to the backlight intensity of each effective backlight block corresponding to the first pixel and the backlight diffusion weight of the effective backlight block corresponding to the first pixel. Backlight intensities corresponding to second to Mth pixels in the Tth group of pixels can be calculated simply by the backlight intensity corresponding to the first pixel in the Tth group of pixels and the backlight intensity corresponding to the first pixel in the (T+1)th group of pixels. Besides, the backlight intensity corresponding to the first pixel in the Nth group of pixels is set as backlight intensities corresponding to second to Mth pixels in the Nth group of pixels. In this way, the speed of obtaining the backlight intensities corresponding to all pixels in the N group of pixels may be improved, which means the processing speed of the display device may be improved.

Figure 4B:
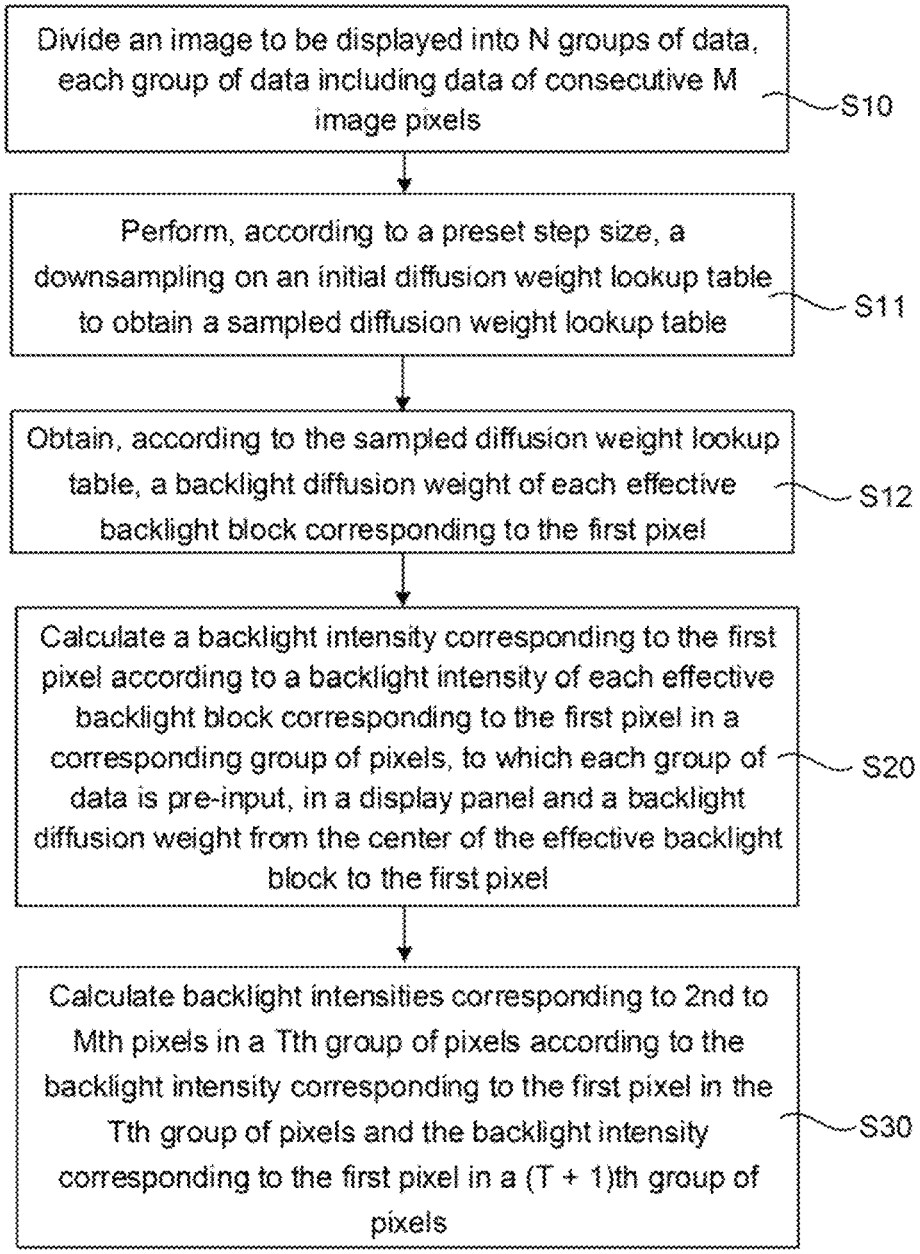
FIG. 4B is a flowchart of another method for obtaining the backlight intensity, in accordance with some embodiments.

In some embodiments, before S20 in which the backlight intensity corresponding to the first pixel is calculated according to the backlight intensity of each effective backlight block corresponding to the first pixel and the backlight diffusion weight of the effective backlight block corresponding to the first pixel, as shown in FIG. 4B, the method further includes the following S11 to S12.

In S11, according to a preset step size, a downsampling is performed on an initial diffusion weight lookup table to obtain a sampled diffusion weight lookup table.

The initial diffusion weight lookup table includes correspondences between distances from the center of each backlight block 40 of the backlight module 4 to pixels in the display panel 3 covered by light emitted from the backlight block 40 and backlight diffusion weights. Each distance includes a horizontal distance and a vertical distance. The backlight diffusion weight characterizes the degree of change in brightness of light with distance.

That "downsampling" means that the data in the initial diffusion weight lookup table is sampled at a preset step size to obtain a sampled diffusion weight lookup table.

The preset step size may be set according to actual needs. For example, the preset step size is set to 4 or 8 or 16. That is, the data in the initial diffusion weight lookup table is sampled every 4 pixels, or 8 pixels, or 16 pixels, which may reduce an amount of data.

In S12, according to the sampled diffusion weight lookup table, the backlight diffusion weight of each effective backlight block corresponding to the first pixel is obtained.

Figure 5:
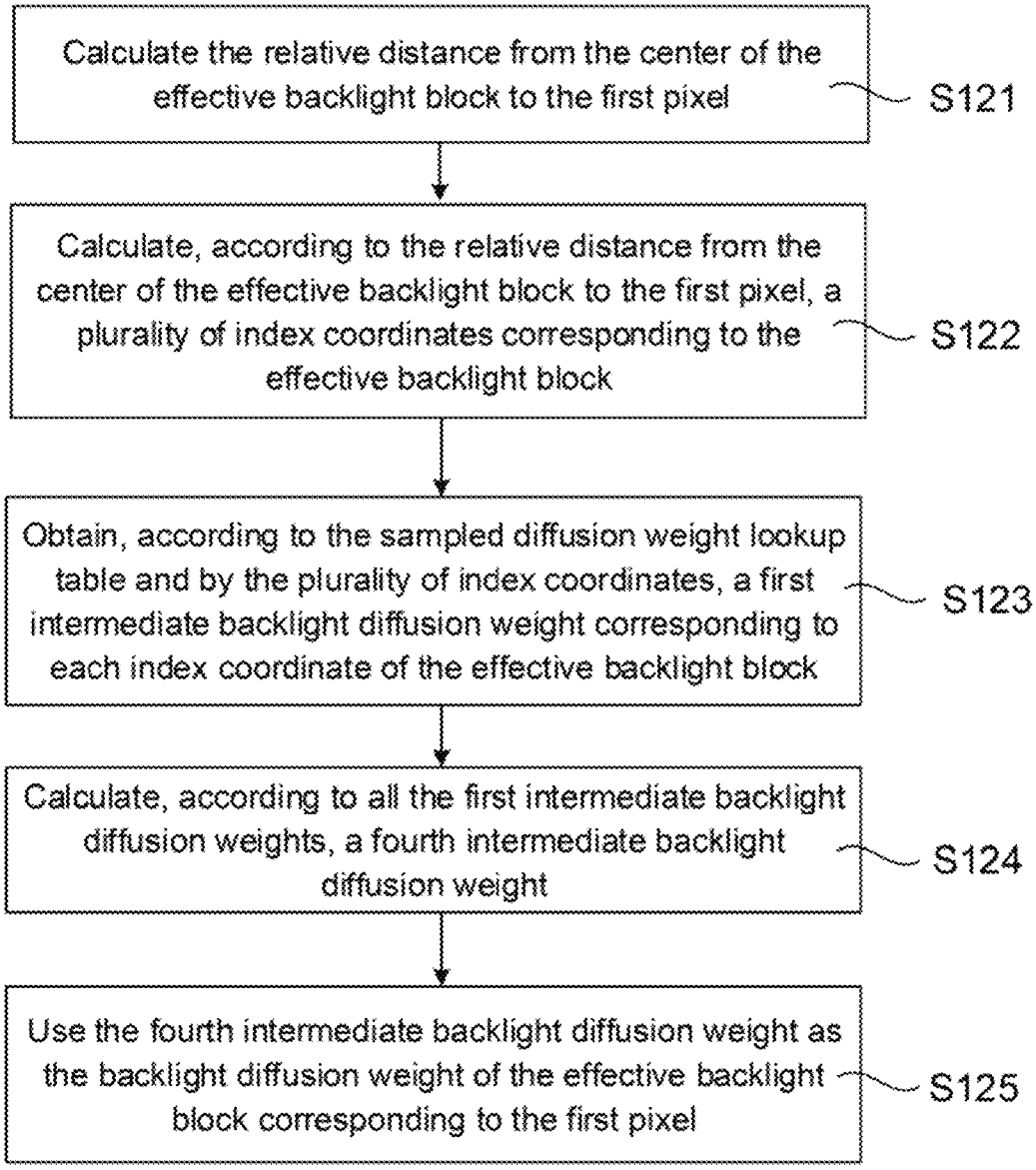
FIG. 5 is a flowchart of yet another method for obtaining the backlight intensity, in accordance with some embodiments.

In some embodiments, as shown in FIG. 5, S12 includes the following S121 to S125.

In S121, the distance from the center of the effective backlight block to the first pixel is calculated.

It will be noted that the distance may be a distance between the center of an orthographic projection of the effective backlight block on a display surface of the display panel 3 and an orthographic projection of the first pixel on the display surface.

Figure 6A:
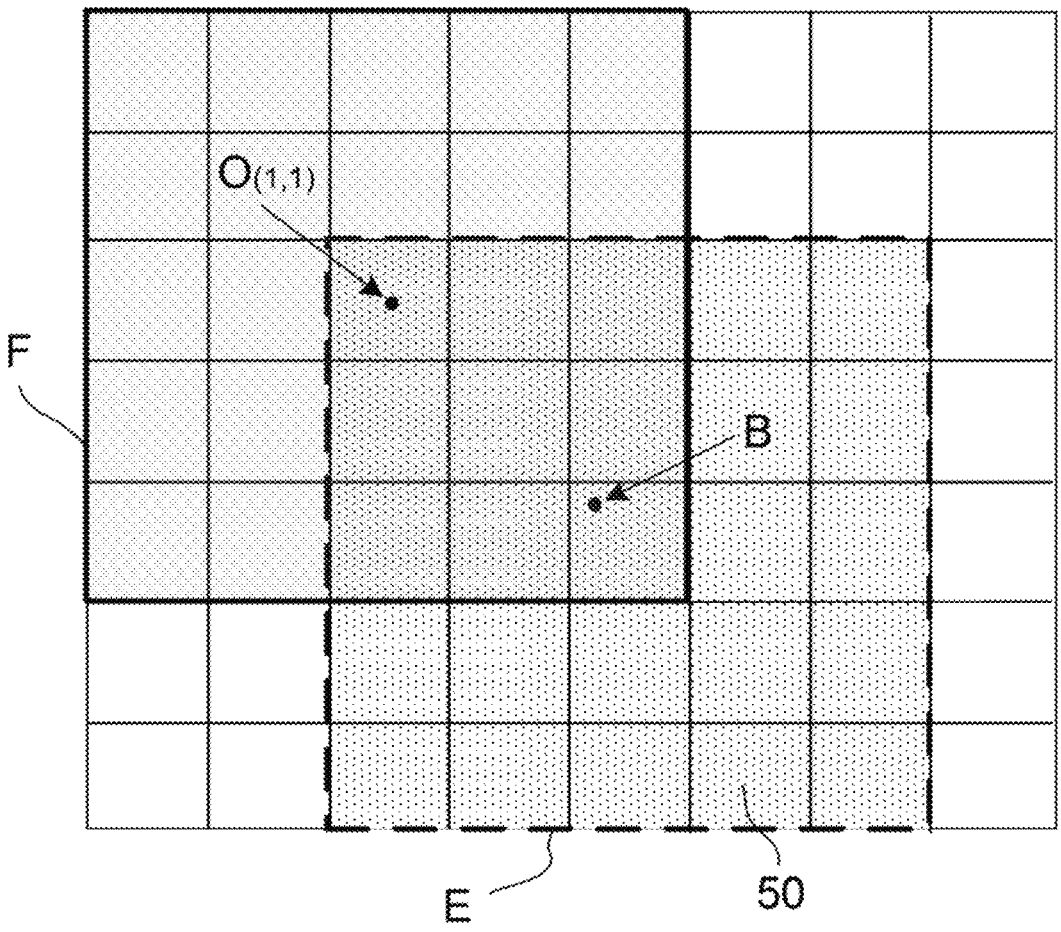
FIG. 6A is a top view of a backlight module, in accordance with some embodiments.

For example, as shown in FIG. 6A, it is assumed that the first pixel B in a tenth group of pixels corresponds to 5×5 effective backlight blocks 50 (located in the region E in FIG. 6A). If the display block 30 corresponding to the effective backlight block 50 includes 40×40 pixels, and the first pixel B is located at a position in row 11 and column 11 in the display block 30 corresponding to the effective backlight block 50 located in row 3 and column 3. Then, the distance from the center of each effective backlight block 50 to the first pixel B can be calculated separately.

For example, as shown in FIG. 6A, the vertical distance dis_v(1) and the horizontal distance dis_h(1) from the center $O_{(1,1)}$ of the effective backlight block 50 in row 1 and column 1 in the region E to the first pixel B are both 70 pixels. Similarly, according to the centers of the other 24 effective backlight blocks 50 in the region E, 24 groups of distances from the centers of the effective backlight blocks 50 to the first pixel B can be obtained.

In S122, according to the obtained distance, a plurality of index coordinates corresponding to the effective backlight block 50 are obtained. The plurality of index coordinates are used to indicate the distance.

It will be noted that, the data of the sampled diffusion weight lookup table is incomplete when compared with the initial diffusion weight lookup table. However, after being processed, the distance is indicated by the index coordinates, and there is no need to directly look up the sampled diffusion weight lookup table according to the distance from the center of each effective backlight block 50 to the first pixel B. In this way, a case where the distance and its corresponding backlight diffusion weight cannot be found may be avoided.

In some embodiments, the S122, in which the plurality of index coordinates corresponding to the effective backlight blocks 50 are obtained according to the distances, includes the following steps.

Four distance values Index_up(i), Index_left(j), Index_down(i) and Index_right(j) are calculated according to $$\text{Index_left}(j) = \left\lfloor \frac{\text{dis_h}(j)}{\text{step}} \right\rfloor, \quad \text{Index_up}(i) = \left\lfloor \frac{\text{dis_v}(i)}{\text{step}} \right\rfloor,$$

$$\text{Index_down}(i) = \left\lfloor \frac{\text{dis_v}(i)}{\text{step}} \right\rfloor + 1, \text{ and}$$

$$\text{Index_right}(j) = \left\lfloor \frac{\text{dis_h}(i)}{\text{step}} \right\rfloor + 1,$$

respectively.

Here, both i and j are positive integers, and i and j are used to indicate that the effective backlight block 50 is the effective backlight block 50 in row i and column j. the dis_v(i) and dis_h(j) represent the vertical distance and the horizontal distance from the center of the effective backlight block 50 in row i and column j to the first pixel B, respectively. Besides, the function $y=\lfloor x \rfloor$ represents a floor function (also known as the greatest integer function) here and later, and step represents the preset step size.

Then, four index coordinates (Index_up(i), Index_left(j)), (Index_up(i), Index_right(j)), (Index_down(i), Index_left(j)), (Index_down(i), Index_right(j)) are generated according to the four distance values Index_up(i), Index_left(j), Index_down(i) and Index_right(j).

For example, with continued reference to FIG. 6A, the vertical distance dis_v(1) and the horizontal distance dis_h(1) from the center $O_{(1,1)}$ of the effective backlight block 50 in row 1 and column 1 in the region E to the first pixel B are both 70, and the preset step size is 4, the four distance values may be calculated according to $$\text{Index_up}(1) = \left\lfloor \frac{70}{4} \right\rfloor = 17,$$

$$\text{Index_down}(1) = \left\lfloor \frac{70}{4} \right\rfloor + 1 = 18,$$

$$\text{Index_left}(1) = \left\lfloor \frac{70}{4} \right\rfloor = 17, \text{ and}$$

$$\text{Index_right}(1) = \left\lfloor \frac{70}{4} \right\rfloor + 1 = 18.$$

Then, the four index coordinates (17, 17), (17, 18), (18, 17) and (18, 18) of the effective backlight block 50 are generated according to the four distance values 17, 18, 17 and 18.

In S123, according to the sampled diffusion weight lookup table and the plurality of index coordinates obtained in S122, a first intermediate backlight diffusion weight corresponding to each index coordinate is obtained.

For example, with continued reference to FIG. 6A, if the effective backlight block 50 in row 1 and column 1 in the region E is turned on, 200×200 pixels centered by $O_{(1,1)}$ (that is, the pixels in the region F in FIG. 6A) are within the backlight diffusion region of the turned-on effective backlight block 50. In this case, there are 100×100 correspondences of these 200×200 pixels and the corresponding backlight diffusion weights of the effective backlight block 50 in the initial diffusion weight lookup table. After the downsampling is performed at a step size of 4, there are 25×25 correspondences in the sampled diffusion weight lookup table.

Figure 6B:
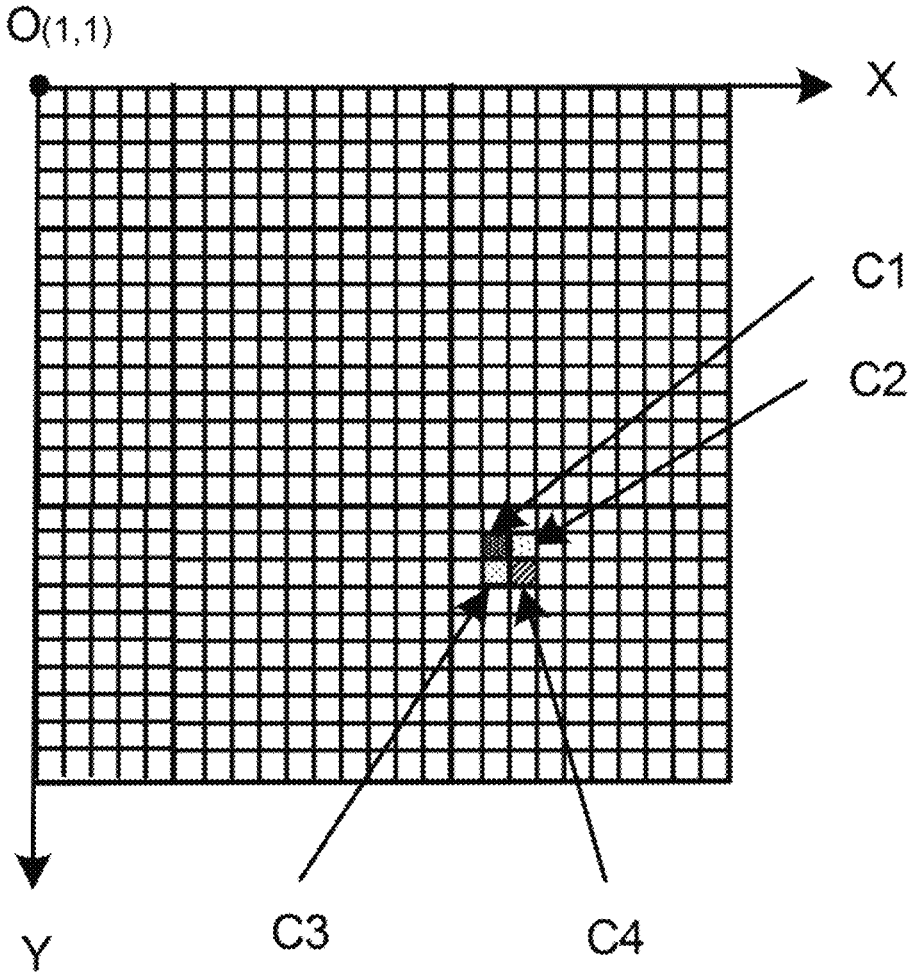
FIG. 6B is a schematic diagram of a sampled diffusion weight lookup table, in accordance with some embodiments.

For example, as shown in FIG. 6B, the direction OX represents a horizontal direction and the direction OY represents a vertical direction. According to the index coordinates (17, 17), (17, 18), (18, 17) and (18, 18) obtained in S122, four corresponding first intermediate backlight diffusion weights can be found at positions C1, C2, C3 and C4 in the sampled diffusion weight lookup table, respectively. For example, the first intermediate backlight diffusion weight W_a(1, 1) corresponding to the index coordinate (17, 17) is 0.46, the first intermediate backlight diffusion weight W_b(1, 1) corresponding to the index coordinate (17, 18) is 0.42, the first intermediate backlight diffusion weight W_c(1, 1) corresponding to the index coordinate (18, 17) is 0.42, and the first intermediate backlight diffusion weight W_d(1, 1) corresponding to the index coordinate (18, 18) is 0.32.

In S124, a fourth intermediate backlight diffusion weight is calculated according to all the first intermediate backlight diffusion weights.

In S125, the fourth intermediate backlight diffusion weight is set as the backlight diffusion weight of the effective backlight block 50 corresponding to the first pixel.

Figure 7A:
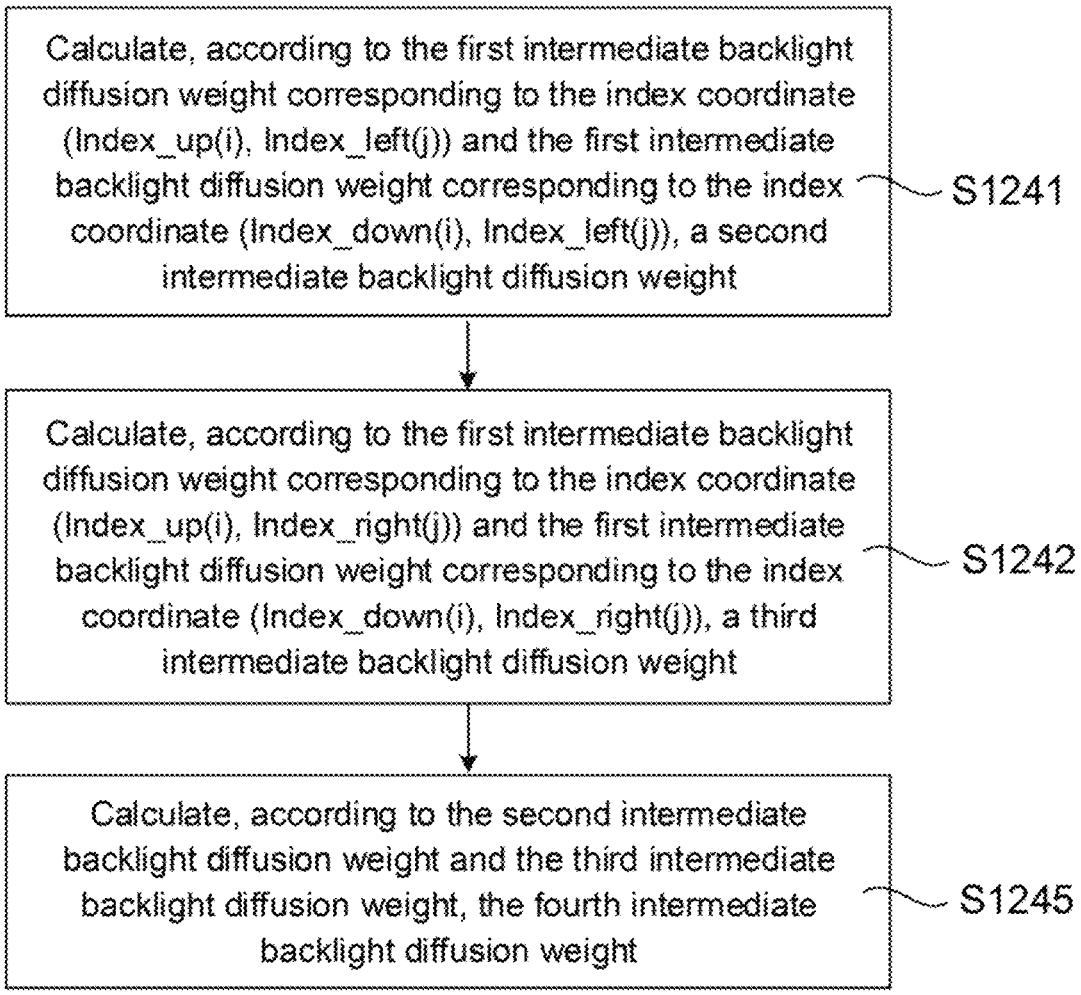
FIG. 7A is a flowchart of yet another method for obtaining the backlight intensity, in accordance with some embodiments.
Figure 8:
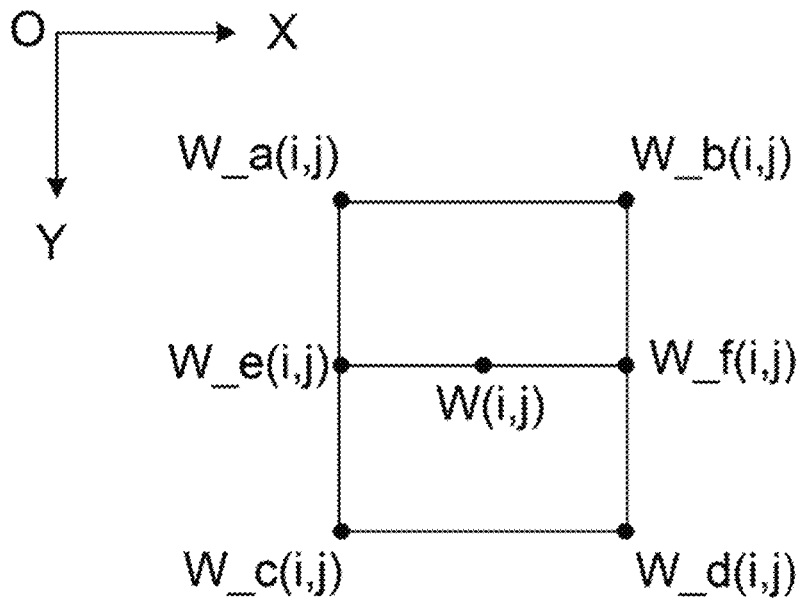
FIG. 8 is a schematic view showing a way to calculate a fourth intermediate diffusion weight, in accordance with some embodiments.

In some embodiments, as shown in FIGS. 7A and 8, the S124, in which the fourth intermediate backlight diffusion weight is calculated according to all the first intermediate backlight diffusion weights, includes the following S1241 to S1245.

In S1241, a second intermediate backlight diffusion weight W_e(i, j) is calculated according to the first intermediate backlight diffusion weight W_a(i, j) corresponding to the index coordinate (Index_up(i), Index_left(j)) and the first intermediate backlight diffusion weight W_c(i, j) corresponding to the index coordinate (Index_down(i), Index_left(j)).

In S1242, a third intermediate backlight diffusion weight W_f(i, j) is calculated according to the first intermediate backlight diffusion weight W_b(i, j) corresponding to the index coordinate (Index_up(i), Index_right(j)) and the first intermediate backlight diffusion weight W_d(i, j) corresponding to the index coordinate (Index_down(i), Index_right(j)).

In S1245, the fourth intermediate backlight diffusion weight W(i, j) is calculated according to the second intermediate backlight diffusion weight W_e(i, j) and the third intermediate backlight diffusion weight W_f(i, j).

In some embodiments, as show in FIGS. 7C and 8, the S1241, in which the second intermediate backlight diffusion weight W_e(i, j) is calculated according to the first intermediate backlight diffusion weight W_a(i, j) corresponding to the index coordinate (Index_up(i), Index_left(j)) and the first intermediate backlight diffusion weight W_c(i, j) corresponding to the index coordinate (Index_down(i), Index_left(j)), includes the following S1001.

In S1001, the second intermediate backlight diffusion weight W_e(i, j) is calculated according to:

$$\text{W_e}(i, j) = \text{W_a}(i, j) - \left\lfloor (\text{W_a}(i, j) - \text{W_c}(i, j)) \times \frac{\text{dis_v}(i)\ \%\ \text{step}}{\text{step}} + 0.5 \right\rfloor. \quad (1)$$

The S1242, in which the third intermediate backlight diffusion weight W_f(i, j) is calculated according to the first intermediate backlight diffusion weight W_b(i, j) corresponding to the index coordinate (Index_up(i), Index_right(D) and the first intermediate backlight diffusion weight W_d(i, j) corresponding to the index coordinate (Index_down(i), Index_right(j)), includes the following S1002.

In S1002, the third intermediate backlight diffusion weight W_f(i, j) is calculated according to:

$$\text{W_f}(i, j) = \text{W_b}(i, j) - \left\lfloor (\text{W_b}(i, j) - \text{W_d}(i, j)) \times \frac{\text{dis_v}(i)\ \%\ \text{step}}{\text{step}} + 0.5 \right\rfloor. \quad (2)$$

Here, that "%" represents a remainder operation; W_a(i, j) is the first intermediate backlight diffusion weight corresponding to the index coordinate (Index_up(i), Index_left(j)); W_b(i, j) is the first intermediate backlight diffusion weight corresponding to the index coordinate (Index_up(i), Index_right(j)); W_c(i, j) is the first intermediate backlight diffusion weight corresponding to the index coordinate (Index_down(i), Index_left(j)); and W_d(i, j) is the first intermediate backlight diffusion weight corresponding to the index coordinate (Index_down(i), Index_right(j)).

The S1245, in which the fourth intermediate backlight diffusion weight W(i, j) is calculated according to the second intermediate backlight diffusion weight W_e(i, j) and the third intermediate backlight diffusion weight W_f(i, j), includes the following S1003.

In S1003, the fourth intermediate backlight diffusion weight W(i, j) is calculated according to:

$$W(i, j) = \text{W_e}(i, j) - \left\lfloor (\text{W_e}(i, j) - \text{W_f}(i, j)) \times \frac{\text{dis_h}(j)\ \%\ \text{step}}{\text{step}} + 0.5 \right\rfloor. \quad (3)$$

In an example where i is 1 and j is 1, as shown in FIG. 8, the first intermediate backlight diffusion weights W_a(1,1), W_b(1,1), W_c(1,1) and W_d(1,1) obtained in the S123 are 0.46, 0.42, 0.42 and 0.32, respectively. Then the second intermediate backlight diffusion weight W_e(1, 1) and the third intermediate backlight diffusion weight W_f(1, 1) are obtained as follows:

$$\text{W_e}(1, 1) = 0.46 - \left\lfloor (0.46 - 0.42) \times \frac{70\%\ 4}{4} + 0.5 \right\rfloor = 0.46;$$

$$\text{W_f}(1, 1) = 0.42 - \left\lfloor (0.42 - 0.32) \times \frac{70\%\ 4}{4} + 0.5 \right\rfloor = 0.42.$$

That is, the second intermediate backlight diffusion weight W_e(1, 1) is 0.46, and the third intermediate backlight diffusion weight W_f(1, 1) is 0.42.

Then, the second intermediate backlight diffusion weight W_e(1, 1) and the third intermediate backlight diffusion weight W_f(1, 1) are substituted into the Formula (3) to obtain the fourth intermediate backlight diffusion weight W(1, 1). The fourth intermediate backlight diffusion weight W(1,1) is obtained as follows:

$$W(1, 1) = 0.46 - \left\lfloor (0.46 - 0.42) \times \frac{70\%\ 4}{4} + 0.5 \right\rfloor = 0.46.$$

That is, the fourth intermediate backlight diffusion weight W(1, 1) is 0.46.

Accordingly, the fourth intermediate backlight diffusion weight W(1, 1), i.e., 0.46, is set as the backlight diffusion weight of the effective backlight block 50 in row 1 and column 1 in the region E corresponding to the first pixel B.

Figure 7B:
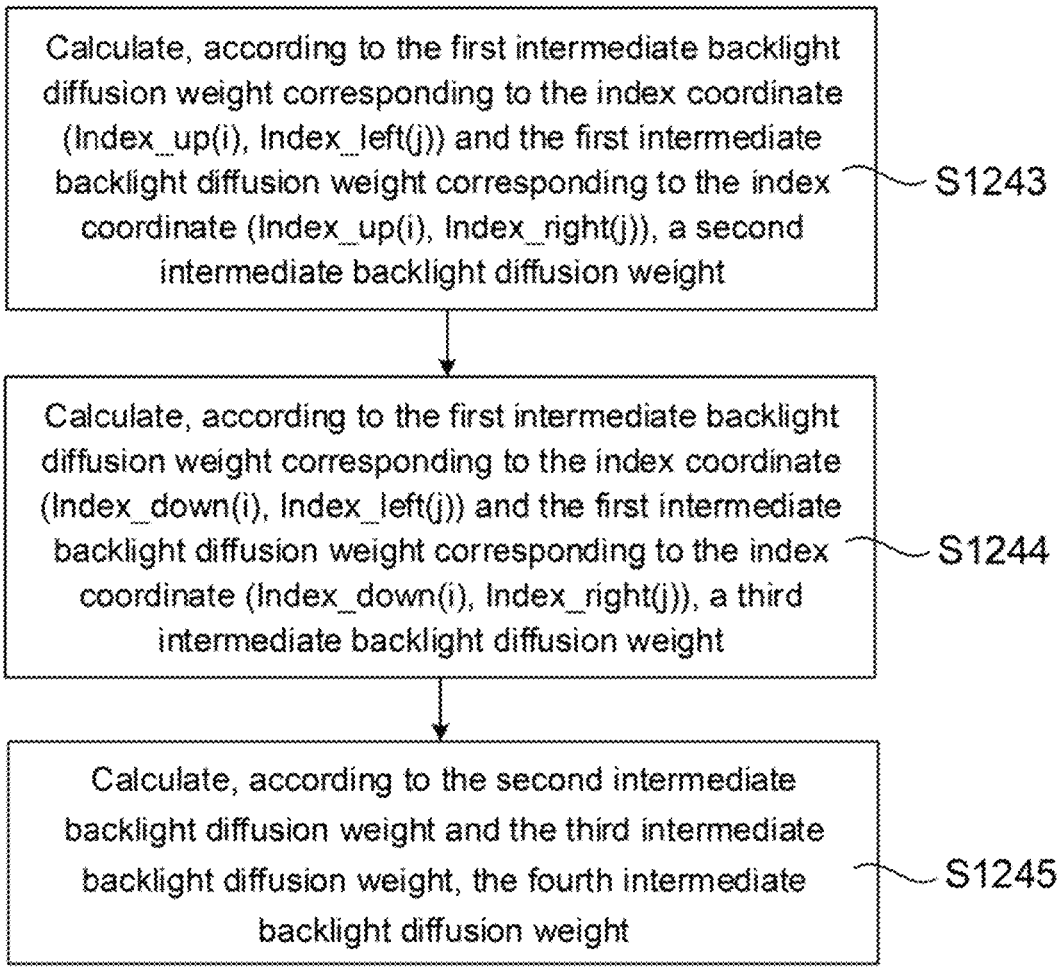
FIG. 7B is a flowchart of yet another method for obtaining the backlight intensity, in accordance with some embodiments.
Figure 9:
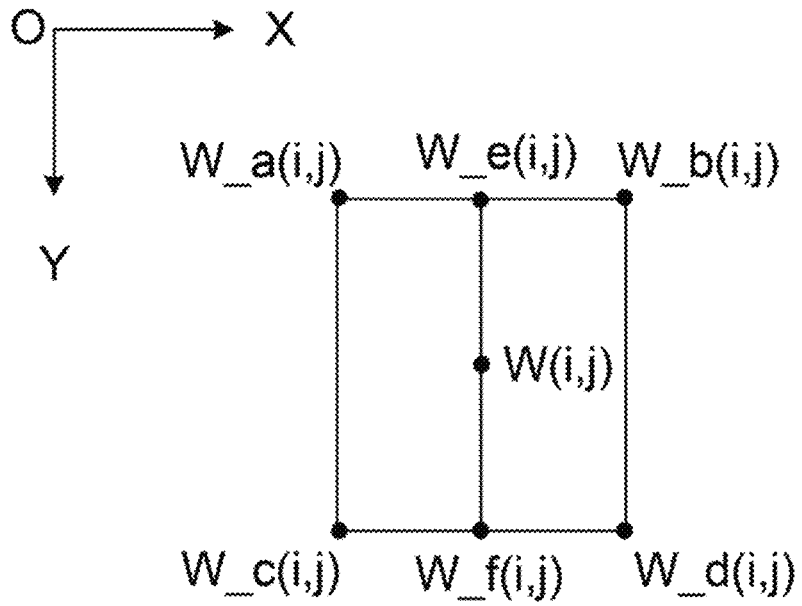
FIG. 9 is a schematic view showing another way to calculate the fourth intermediate diffusion weight, in accordance with some embodiments.
Figure 10:
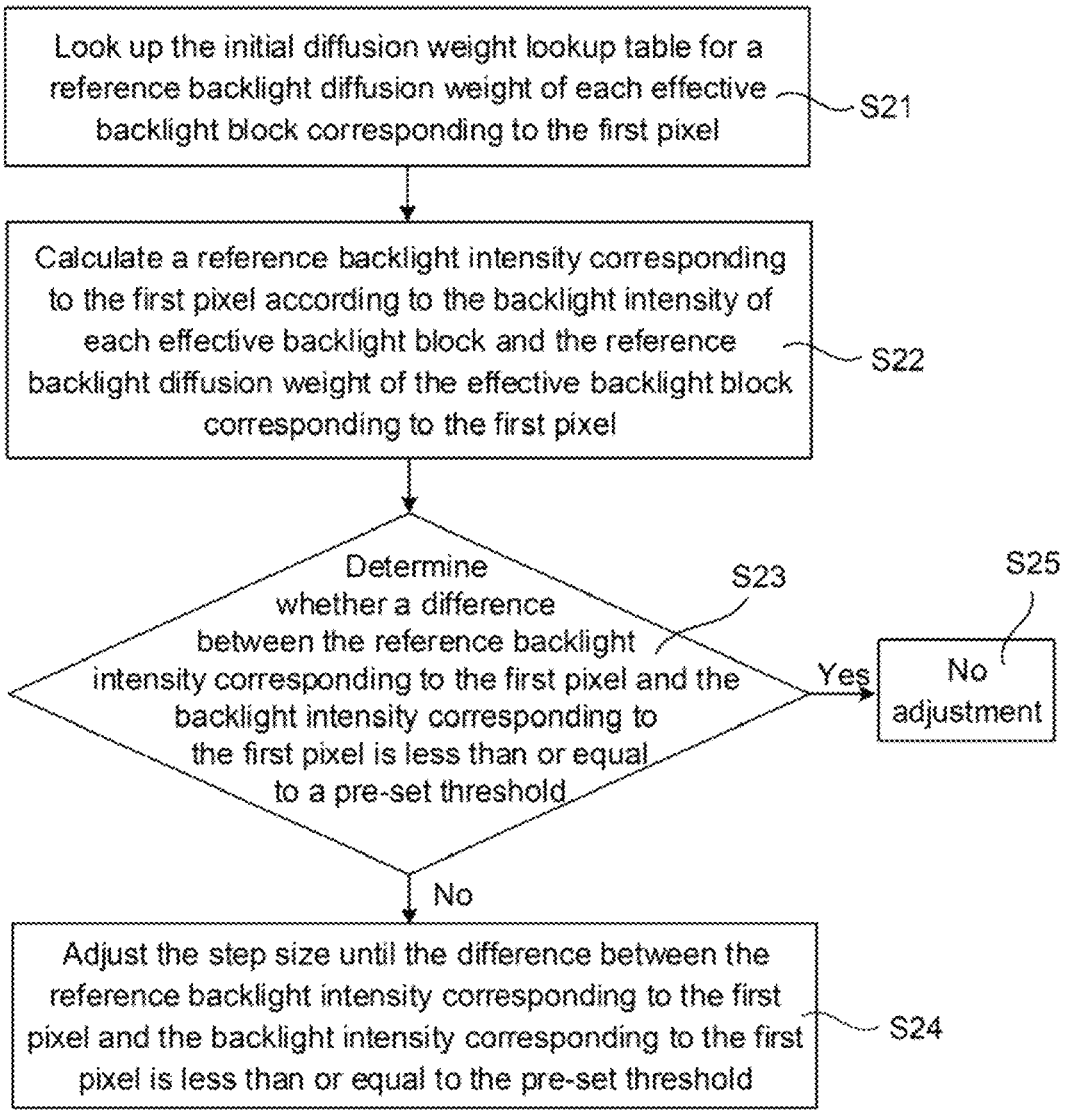
FIG. 10 is a flowchart of yet another method for obtaining the backlight intensity, in accordance with some embodiments.

In some other embodiments, as shown in FIGS. 7B and 9, the S124, in which the fourth intermediate backlight diffusion weight is calculated according to all the first intermediate backlight diffusion weights, includes the following S1243 to S1245.

In S1243, the second intermediate backlight diffusion weight W_e(i, j) is calculated according to the first intermediate backlight diffusion weight W_a(i, j) corresponding to the index coordinate (Index_up(i), Index_left(j)) and the first intermediate backlight diffusion weight W_b(i, j) corresponding to the index coordinate (Index_up(i), Index_right(j)).

In S1244, the third intermediate backlight diffusion weight W_f(i, j) is calculated according to the first intermediate backlight diffusion weight W_c(i, j) corresponding to the index coordinate (Index_down(i), Index_left(j)) and the first intermediate backlight diffusion weight W_d(i, j) corresponding to the index coordinate (Index_down(i), Index_right(j)).

In S1245, the fourth intermediate backlight diffusion weight W(i, j) is calculated according to the second intermediate backlight diffusion weight W_e(i, j) and the third intermediate backlight diffusion weight W_f(i, j).

In some embodiments, as shown in FIGS. 7D and 9, the S1243, in which the second intermediate backlight diffusion weight W_e(i, j) is calculated according to the first intermediate backlight diffusion weight W_a(i, j) corresponding to the index coordinate (Index_up(i), Index_left(j)) and the first intermediate backlight diffusion weight W_b(i, j) corresponding to the index coordinate (Index_up(i), Index_right(j)), includes the following S1004.

In S1004, the second intermediate backlight diffusion weight W_e(i, j) is calculated according to:

$$\text{W_e}(i, j) = \text{W_a}(i, j) - \left\lfloor (\text{W_a}(i, j) - \text{W_b}(i, j)) \times \frac{\text{dis_h}(j) \ \% \ \text{step}}{\text{step}} + 0.5 \right\rfloor. \quad (4)$$

The S1244, in which the third intermediate backlight diffusion weight W_f(i, j) is calculated according to the first intermediate backlight diffusion weight W_c(i, j) corresponding to an index coordinate (Index_down(i), Index_left (j)) and the first intermediate backlight diffusion weight W_d(i, j) corresponding to an index coordinate (Index_down(i), Index_right(j)), includes the following S1005.

In S1005, the third intermediate backlight diffusion weight W_f(i, j) is calculated according to:

$$\text{W_f}(i, j) = \text{W_c}(i, j) - \left\lfloor (\text{W_c}(i, j) - \text{W_d}(i, j)) \times \frac{\text{dis_h}(j) \ \% \ \text{step}}{\text{step}} + 0.5 \right\rfloor. \quad (5)$$

The S1245, in which the fourth intermediate backlight diffusion weight W(i, j) is calculated according to the second intermediate backlight diffusion weight W_e(i, j) and the third intermediate backlight diffusion weight W_f(i, j), include the following S1006.

In S1006, the fourth intermediate backlight diffusion weight W(i, j) is calculated according to:

$$W(i, j) = \text{W_e}(i, j) - \left\lfloor (\text{W_e}(i, j) - \text{W_f}(i, j)) \times \frac{\text{dis_v}(i) \ \% \ \text{step}}{\text{step}} + 0.5 \right\rfloor. \quad (6)$$

In some embodiments, the S20, in which the backlight intensity corresponding to the first pixel is calculated according to the backlight intensity of each effective backlight block corresponding to the first pixel and the backlight diffusion weight of the effective backlight block corresponding to the first pixel includes the following step.

The number of the effective backlight blocks 50 is determined as (k×k), i.e., a product of k and k; for the first pixel in a Xth group of pixels, a backlight intensity corresponding to the first pixel in the Xth group of pixels is calculated according to:

$$BL_{pix(x,1)} = \sum_{i=1}^{k} \sum_{j=1}^{k} W(i, j) \times BL(i, j), \quad (7)$$

Where N≥X≥1 and X is a positive integer; k is a positive integer; BL(i, j) is the backlight intensity of the effective backlight block 50 in row i and column j; and $BL_{pix(x,1)}$ is the backlight intensity corresponding to the first pixel in the Xth group of pixels.

For example, as shown in FIG. 6A, there are 5 c 5 (that is, 25) effective backlight blocks 50 for the pixel B, that is, k is 5. Then the backlight diffusion weight of each effective backlight block 50 in the region E corresponding to the first pixel B is calculated according to S121 to S125. In this way, the backlight diffusion weights of the 25 effective backlight blocks 50 corresponding to the first pixel B are obtained, and are recorded as W(1, 1), W(1, 2), W(1, 3), . . . , up to W(5, 5). Then, the backlight intensities BL(1, 1), BL(1, 2), BL(1, 3), . . . , up to BL(5, 5) of the 25 effective backlight blocks 50 are obtained according to the maximum value method.

Then, the backlight intensity $BL_{pix(10,1)}$ corresponding to the first pixel B is obtained according to:

$$BL_{pix(10,1)} = \sum_{i=1}^{5} \sum_{j=1}^{5} W(i, j) \times BL(i, j).$$

In some examples, in order to make the result of calculation more accurate, the first intermediate backlight diffusion weights W_a(i, j), W_b(i, j), W_c(i, j), W_d(i, j) may be performed a shift operation to become integers; then the backlight intensity is calculated by using the shifted first intermediate backlight diffusion weights; and then the calculated backlight intensity is performed a shift operation (for example, a shift operation in an opposite direction) to obtain the backlight intensity corresponding to the first pixel. It will be understood that the number of shift bits in the shift operation may be selected as required.

In some embodiments, the S30, in which the backlight intensities corresponding to second to Mth pixels in the Tth group of pixels are calculated according to the backlight intensity corresponding to the first pixel in the Tth group of pixels and the backlight intensity corresponding to the first pixel in a (T+1)th group of pixels, includes the following step.

A backlight intensity corresponding to a Pth pixel in the Tth group of pixels is calculated according to:

$$BL_{pix(t,p)} = BL_{pix(t,1)} + \left\lfloor (BL_{pix(t+1,1)} - BL_{pix(t,1)}) \times \frac{P-1}{M} + 0.5 \right\rfloor. \quad (8)$$

Where P is greater than or equal to 2, and less than equal to M; $BL_{pix(t,p)}$ is the backlight intensity corresponding to the Pth pixel in the Tth group of pixels; $BL_{pix(t,1)}$ is the backlight intensity corresponding to the first pixel in the Tth group of pixels; and $BL_{pix(+1,1)}$ is the backlight intensity corresponding to the first pixel in the (T+1)th group of pixels.

For example, if X (i.e., t) is 3, then the backlight intensity corresponding to the first pixel in a third group of pixels is 6. If X [i.e., (t+1)] is 4, the backlight intensity corresponding to the first pixel in a fourth group of pixels is 7. It is assumed that a set of data received by FPGA or the timing controller includes data of 6 image pixels.

In this case, according to $$BL_{pix(3,p)} = 6 + \left\lfloor (7-6) \times \frac{P-1}{6} + 0.5 \right\rfloor,$$

if P is 2, then $BL_{pix(3,2)}$ is 6; if P is 4, then $BL_{pix(3,4)}$ is 7; and if P is 6, then $BL_{pix(3,6)}$ is 7. That is, the backlight intensity corresponding to the second pixel in the third group of pixels is 6, the backlight intensity corresponding to the fourth pixel in the third group of pixels is 7, and the backlight intensity corresponding to the sixth pixel in the third group of pixels is also 7.

On this basis, in order to make the calculated backlight intensity corresponding to the pixel more accurate, the preset step size may be adjusted.

In some examples, after the S20, in which the backlight intensity corresponding to the first pixel is calculated according to the backlight intensity of each effective backlight block corresponding to the first pixel and the backlight diffusion weight of the effective backlight block corresponding to the first pixel, as shown in FIG. 9, the method further includes the following S21 to S24.

In S21, a reference backlight diffusion weight of each effective backlight block corresponding to the first pixel is read from the initial diffusion weight lookup table.

In S22, a reference backlight intensity corresponding to the first pixel is calculated according to a backlight intensity of each effective backlight block and a reference backlight diffusion weight of the effective backlight block corresponding to the first pixel.

In S23, it is determined whether a difference between the reference backlight intensity corresponding to the first pixel and the backlight intensity corresponding to the first pixel is less than or equal to a preset threshold. Here, the preset threshold may be set as required.

In S24, in response to determining that the difference is not less than or equal to the preset threshold, the preset step size is adjusted until the difference between the reference backlight intensity corresponding to the first pixel and the backlight intensity corresponding to the first pixel is less than or equal to the preset threshold.

It will be noted that, the method may further include S25.

In S25, in response to determining that the difference is less than or equal to the preset threshold, no adjustment of the step size is needed.

For example, for a pixel C, there are k'×k' (that is $k'^2$) effective backlight blocks 50. A reference backlight diffusion weight of each effective backlight block 50 corresponding to the pixel C is read from the initial diffusion weight lookup table. Then, the reference backlight diffusion weight may be multiplied by the backlight intensity of the effective backlight block 50 to obtain a backlight intensity of light of each effective backlight block 50 diffused to the pixel C, and the backlight intensities are added up. In this way, the reference backlight intensity $BL_{C_on}$ corresponding to the pixel C may be calculated.

Then, by setting the step size, the initial diffusion weight lookup table is performed a downsampling to obtain a sampled diffusion weight lookup table. After that, for the pixel C, a plurality of index coordinates are calculated according to the distance from the center of each effective backlight block 50 to the pixel C. The first intermediate backlight diffusion weight corresponding to each index coordinate is obtained according to the plurality of index coordinates, and the fourth intermediate backlight diffusion weight is calculated as the backlight diffusion weight corresponding to the pixel C. The backlight intensity of each effective backlight block 50 is obtained by the maximum value method. The backlight diffusion weight of each effective backlight block 50 corresponding to the pixel C is multiplied by the backlight intensity of the effective backlight block 50, and the backlight intensities are added up to obtain the backlight intensity $BL_{C_inter}$ corresponding to the pixel C.

It is determined whether the difference between the backlight intensities $BL_{C_ori}$ and $BL_{C_inter}$ obtained by the two algorithms for the same pixel C is less than or equal to the preset threshold. If so, it may be indicated that the step size is set properly. If not, the step size "step" may need to be adjusted, and the above calculation process is repeated until the difference between the calculated backlight intensities $BL_{C_ori}$ and $BL_{C_inter}$ is less than or equal to the preset threshold.

It will be noted that, the brightness of each pixel in the display panel at each moment is further related to the data of the image pixel (e.g., grayscale value and transmittance of the pixel) corresponding to the pixel in addition to the backlight intensity.

Figure 11:
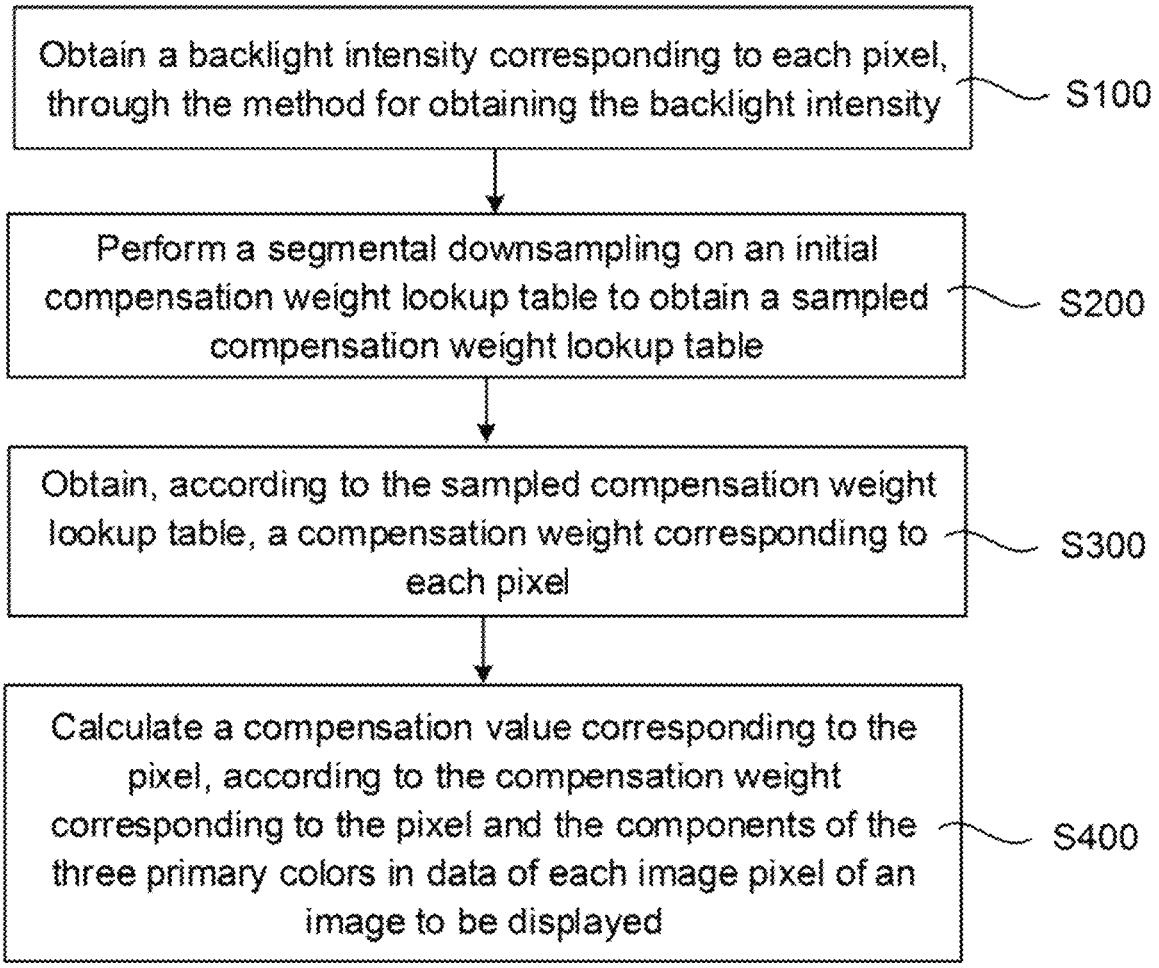
FIG. 11 is a flowchart of a method for obtaining a compensation value, in accordance with some embodiments.

Some embodiments of the present disclosure provide a method for obtaining a compensation value. As shown in FIG. 11, the method included the following steps.

In S100, a backlight intensity corresponding to each pixel is obtained through the method for obtaining the backlight intensity described above.

In S200, a stratified downsampling is performed on an initial compensation weight lookup table to obtain a sampled compensation weight lookup table. The initial compensation weight lookup table includes correspondences among a plurality of initial index values, a plurality of backlight intensities and a plurality of compensation weights, and the initial index values are equal to their corresponding backlight intensities. For example, as shown in FIG. 12A, the initial index values are equal to their corresponding backlight intensities.

It can be understood that in the initial compensation weight lookup table, each initial index value corresponds one backlight intensity and one compensation weight.

It will be noted that as the backlight intensity changes, the compensation value of the pixel will change accordingly. Here, the compensation weight is used to characterize the relationship between the compensation value and the backlight intensity.

In some examples, the backlight intensity may range from 0 to 255 level (that is, there exists 256 backlight intensities). According to a nonlinear compensation method, the compensation weight corresponding to each backlight intensity may be calculated. The backlight intensity range is not limited thereto. For example, the backlight intensity range may also be from 0 to 64 level or from 0 to 1023 level.

For example, when the backlight intensity $BL'_{pix}$ is 1, according to $$W' = \left(\frac{255}{BL'_{pix}}\right)^{\frac{1}{GAM}}$$

and GAM=2.2, the corresponding compensation weight may be obtained:

$$W' = (255)^{\frac{1}{2.2}};$$

when the backlight intensity $BL'_{pix}$ is 2, according to $$W' = \left(\frac{255}{BL'_{pix}}\right)^{\frac{1}{GAM}}$$

and GAM=2.2, the corresponding compensation weight may be obtained:

$$W' = \left(\frac{255}{2}\right)^{\frac{1}{2.2}}.$$

In this way, the compensation weights corresponding to the 256 backlight intensities may be obtained.

For example, as shown in FIG. 12A, the initial compensation weight lookup table is established according to the initial index values, the backlight intensities and the corresponding compensation weights.

In some examples, the S200, in which the stratified downsampling is performed on the initial compensation weight lookup table to obtain the sampled compensation weight lookup table, includes the following steps.

Correspondences between a plurality of sampled index values and a plurality of initial index values are obtained according to $$\begin{cases} 0 \le Y \le 27, & F(Y) = Y \\ 27 < Y \le 34, & F(Y) = 4 \times (Y - 27) + 27, \\ 34 < Y \le 59, & F(Y) = 8 \times (Y - 34) + 55 \end{cases}$$

wherein F(Y) is the initial index value and Y is the sampled index value.

The stratified downsampling is performed on the initial compensation weight lookup table according to the correspondences between the plurality of sampled index values and the plurality of initial index values to obtain the sampled compensation weight lookup table.

For example, the stratified downsampling is performed on the initial compensation weight lookup table shown in FIG. 12A. As shown in FIG. 12B, the sampled compensation weight lookup table is obtained, which includes the plurality of sampled index values and the plurality of compensation weights.

For example, if the sampled index value is 20 (that is, the sampled index value meets the condition $0 \le Y \le 27$, $F(Y)=Y$), the compensation weight corresponding to the sampled index value 20 equals to the compensation weight corresponding to the initial index value 20; if the sampled index value is 34 (that is, the sampled index value meets the condition $27 < Y \le 34$, $F(Y)=4\times(Y-27)+27$), the compensation weight corresponding to the sampled index value 34 equals to the compensation weight corresponding to the initial index value 55; if the sampled index value is 50 (that is, the sampled index value meets the condition $34 < Y \le 59$, $F(Y)=8\times(Y-34)+55$), the compensation weight corresponding to the sampled index value 50 equals to the compensation weight corresponding to the initial index value 183.

In S300, a compensation weight corresponding to each pixel is obtained according to the sampled compensation weight lookup table.

In S400, a compensation value corresponding to each pixel is calculated, according to the compensation weight corresponding to the pixel and the three primary color components in the data of an image pixel corresponding to the pixel.

In the method for obtaining the compensation value described above, the stratified downsampling is performed on the initial compensation weight lookup table to obtain the sampled compensation weight lookup table, which may effectively reduce the amount of data. Besides, according to a segment to which the backlight intensity corresponding to the pixel belongs, the corresponding compensation weight is quickly obtained by looking up the sampled compensation weight lookup table and calculating. Then, according to the three primary color components of each pixel data of the image to be displayed, the compensation value corresponding to the pixel is calculated. In this way, the efficiency is improved.

Figure 13:
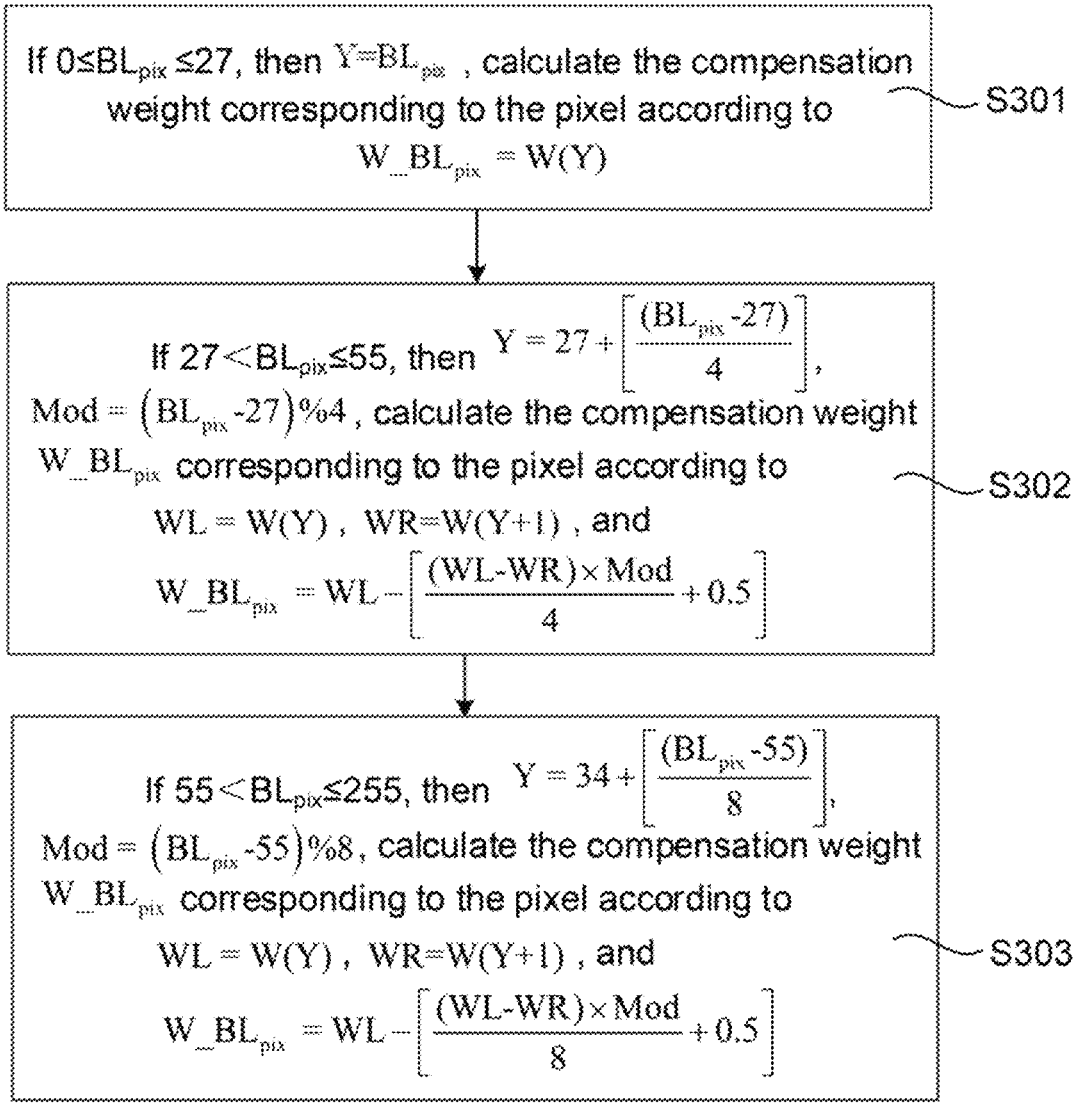
FIG. 13 is a flowchart of another method for obtaining a compensation value, in accordance with some embodiments.

In some examples, as shown in FIG. 13, the S300, in which the compensation weight $W_BL_{pix}$ corresponding to the pixel is obtained according to the sampled compensation weight lookup table, includes following S301 to S303.

In S301, for the backlight intensity corresponding to the pixel, it is determined which range the backlight intensity corresponding to the pixel belongs to; in response to determining that the backlight intensity $BL_{pix}$ corresponding to the pixel is greater than or equals to 0, and is less than or equals to 27, (that is, $0 \le BL_{pix} \le 27$), the sampled index value Y is set to the backlight intensity $BL_{pix}$, and the compensation weight $W_BL_{pix}$ equals to the compensation weight W(Y) corresponding to the sampled index value Y (that is, $Y=BL_{pix}$, $W_BL_{pix}=W(Y)$), so as to obtain the compensation weight $W_BL_{pix}$ corresponding to the pixel. Here, $BL_{pix}$ is the backlight intensity corresponding to the pixel, and W(Y) is the compensation weight corresponding to a sampled index value Y in the sampled compensation weight lookup table.

As for how to determine which range the backlight intensity corresponding to the pixel belongs to, it may be first determined whether the backlight intensity is in the range of 0 to 27; if not, it may be determined whether the backlight intensity is in the range of 27 to 55; if not, it may be then determined whether the backlight intensity is in the range of 55 to 255. Of course, other methods may be used to determine which range the backlight intensity belongs to.

In S302, in response to determining that the backlight intensity $BL_{pix}$ corresponding to the pixel is greater than 27, and is less than or equals to 55, (that is, $27 < BL_{pix} \le 55$), the sampled index value Y equals to a sum of 27 and $$\left\lfloor \frac{(BL_{pix} - 27)}{4} \right\rfloor$$

(that is, $$Y = 27 + \left\lfloor \frac{(BL_{pix} - 27)}{4} \right\rfloor),$$

and $Mod=(BL_{pix}-27)\%4$, and the compensation weight $W_BL_{pix}$ corresponding to the pixel is calculated according to $WL=W(Y)$, $WR=W(Y+1)$, and $$W_BL_{pix} = WL - \left\lfloor \frac{(WL - WR) \times Mod}{4} + 0.5 \right\rfloor.$$

In S303, in response to determining that the backlight intensity $BL_{pix}$ corresponding to the pixel is greater than 55, and is less than or equals to 255, (that is, $55<BL_{pix}\leq 255$), the sampled index value Y equals to a sum of 27 and $$\left\lfloor \frac{(BL_{pix}-55)}{8} \right\rfloor$$

(that is, $$Y = 27 + \left\lfloor \frac{(BL_{pix}-55)}{8} \right\rfloor),$$

and $Mod=(BL_{pix}-55)\%8$, and the compensation weight $W_BL_{pix}$ corresponding to the pixel is calculated according to WL=W(Y), WR=W(Y+1), and $$W_BL_{pix} = WL - \left\lfloor \frac{(WL-WR)\times \mathrm{Mod}}{8} + 0.5 \right\rfloor.$$

Here, W (Y+1) is the compensation weight corresponding to a sampled index value Y+1 in the sampled compensation weight lookup table, and $W_BL_{pix}$ is the compensation weight corresponding to the pixel having the backlight intensity of $BL_{pix}$.

For example, if the backlight intensity $BL_{pix}$ corresponding to a certain pixel is 30, then the sampled index value Y is obtained:

$$Y = 27 + \left\lfloor \frac{(30-27)}{4} \right\rfloor = 27,$$

Mod=(30−27)%4=4, and according to WL=W(27) and WL=W(28), the compensation weight lookup table is looked up for compensation weights $W_BL_{pix}$ at the sampled index values 27 and 28 to obtain WL=W(27)=0.48, WR=W(28)=0.46. Thus, according to $$W_BL_{pix} = 0.48 - \left\lfloor \frac{(0.48-0.46)\times 4}{4} + 0.5 \right\rfloor = 0.48,$$

it will be known that the compensation weight $W_BL_{pix}$ corresponding to the pixel with the backlight intensity $BL_{pix}$ of 30 is 0.48.

In some embodiments, the S400, in which the compensation value corresponding to each pixel is calculated according to the compensation weight corresponding to the pixel and the three primary color components of the data of an image pixel corresponding to the pixel, includes the following step.

For each pixel, a product of a red brightness value R and the compensation weight $W_BL_{pix}$ corresponding to the pixel is calculated as a red brightness compensation value R' (that is, $R'=R\times W_BL_{pix}$), a product of a green brightness value G and the compensation weight $W_BL_{pix}$ corresponding to the pixel is calculated as a green brightness compensation value G' (that is, $G'=G\times W_BL_{pix}$), and a product of a blue brightness value B and the compensation weight $W_BL_{pix}$ corresponding to the pixel is calculated as a blue brightness compensation value B' (that is, $B'=B\times W_BL_{pix}$).

It will be noted that, that "the three primary color components of the data" refers to the red brightness value R, the green brightness value G and the blue brightness value B.

For example, if the red brightness value R is 200, the green brightness value R is 240, and the blue brightness value R is 180 in the data of the image pixel corresponding to the pixel, the backlight intensity corresponding to the pixel (in the display panel 30) receiving the data of the image pixel is 30. Then, the compensation weight read from the sampled compensation weight lookup table is 0.48. Therefore, R'=200×0.48=96, G'=240×0.48=115.2, B'=180×0.48=86.4. That is, the red brightness compensation R' value is 96, the green brightness compensation value G' is 115.2, and the blue brightness compensation value B' is 86.4.

In some embodiments, after the S400, the method further include calculating sum of the compensation value corresponding to each pixel and the three primary color components of the data of an image pixel corresponding to the pixel. The pixel includes, for example, a red sub-pixel, a blue sub-pixel and a green sub-pixel. In this case, a sum of the red brightness value R and the red brightness compensation R' value is calculated, and the sum (R+R') is used as the red component data input into the red sub-pixel of the pixel. Similarly, a sum (G+G') is used as the green component data input into the green sub-pixel, and a sum (B+B') is used as the blue component data input into the blue sub-pixel, so that the display panel may display the image.

In some examples, in order to make the result of calculation more accurate, first, the compensation weights WL and WR may be performed a shift operation. After the compensation values are calculated by using the shifted compensation weights, the compensation values may be performed a shift operation (for example, a shift operation in an opposite direction) to obtain the compensation value corresponding to the pixel. The number of shift bits in the shift operation may be set as required.

Some embodiments of the present disclosure provide a computer device, including a storage unit and a processing unit. The storage unit stores computer programs that, when executed by the processing unit, perform the method for obtaining the backlight intensity described above and/or the method for obtaining the compensation value described above.

Some embodiments of the present disclosure provide a non-transitory computer readable storage medium storing computer programs that, when executed by a processor, perform the method for obtaining the backlight intensity described above and/or the method for obtaining the compensation value described above.

It will be understood by a person of ordinary skill in the art that all or part of the steps to implement the above method embodiments may be accomplished by program instructions related hardware. The programs may be stored in the computer readable storage medium, and can perform, when executed by the processor, the steps of the above method embodiments.

The computer readable storage medium may include, but not limited to a magnetic storage device (e.g., a hard disk, a floppy disk, a magnetic tape, etc.), an optical disk (e.g., a compact disks (CD), a digital versatile disk (DVD), etc.), a smart card or a flash device (e.g., an erasable programmable read-only memory (EPROM), a card, a bar, a key driver, etc.). The computer-readable storage medium described in the present disclosure may represent one or more devices for storing information and/or other machine-readable storage media. The term "computer-readable storage medium" may include, but not limited to a wireless channel and various other media capable of storing, containing and/or loading instructions and/or data.

Figure 14:
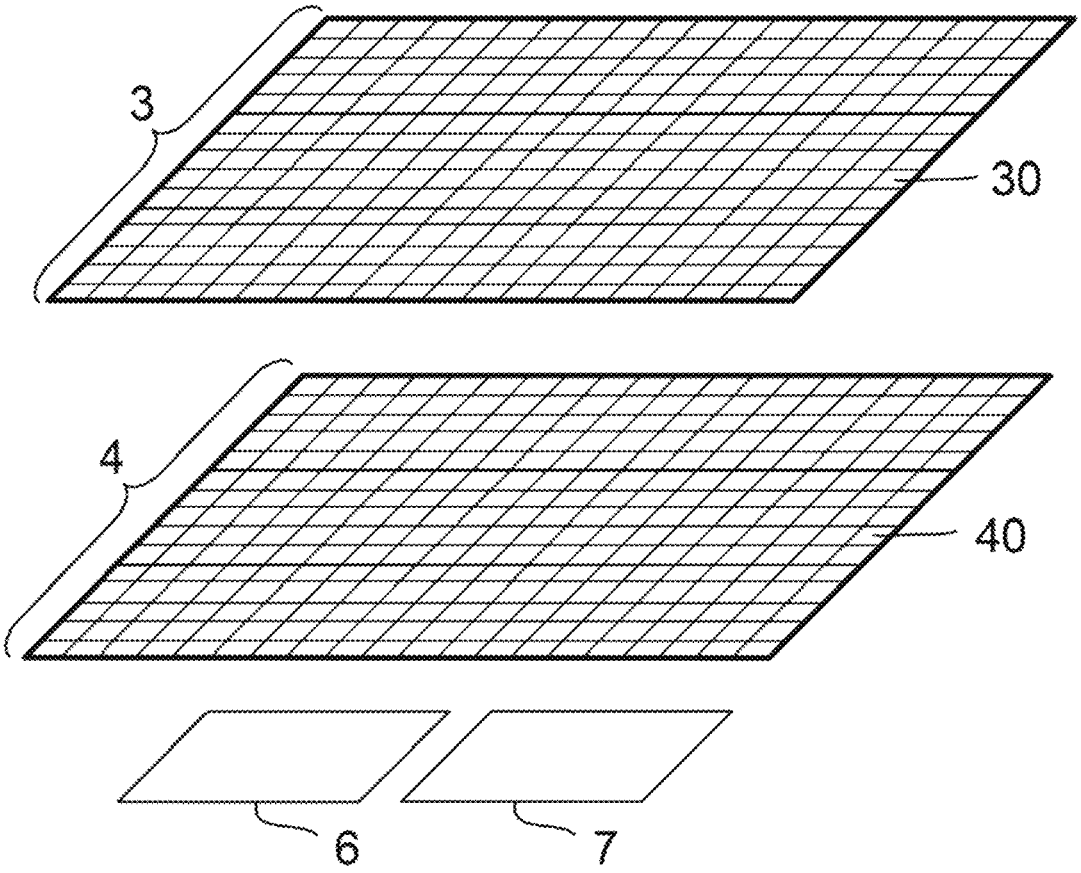
FIG. 14 is a schematic diagram showing a structure of a display device, in accordance with some embodiments.

In some embodiments of the present disclosure, in addition to the display panel 3 and the backlight module 4, the display device, as shown in FIG. 14, further includes a memory 6 and a processor 7.

The memory 6 stores computer programs that, when executed by the processor 7, perform the method for obtaining the backlight intensity described above and/or the method for obtaining the compensation value described above.

The memory 6 may further store results of the computer programs executed by the processor 7. In addition, the memory 6 may further store any lookup table and any data described above.

The memory 6 may be a read-only memory (ROM) or other types of static storage devices capable of storing static information and instructions, a random access memory (RAM) or other types of dynamic storage devices capable of storing information and instructions. The memory may also be an electrically erasable programmable read-only memory (EEPROM), a compact disc read-only memory (CD-ROM) or other optical disk storages, optical disc storages (including compact disc, laser disc, optical disc, digital versatile optical disc, Blu-ray disc, etc.), magnetic disk storage media or other magnetic storage devices, or any other media that can be used to carry or store desired program codes in form of instructions or data structures and can be accessed by a computer.

With regard to the processor 7, reference may be made to the above description, and details will not be repeated.

The above embodiments are merely some implementations of the present disclosure, and the protection scope of the present disclosure is not limited thereto. Any changes or replacements obtained by a person of ordinary skill in the art without departing from the technical scope of the present disclosure should be included within the protection scope of the present disclosure. Therefore, the protection scope of the present disclosure shall be subject to the protection scope of the claims.

What is claimed is:

1. A method for obtaining a backlight intensity, comprising:

dividing image data of an image to be displayed into N sets of data, each set of data including data of consecutive M image pixels, wherein each set of data corresponds to a respective one of N groups of pixels in a display panel and a respective one of N backlight blocks of a display module, and, wherein N is an integer greater than 1 and M is an integer greater than 1;

calculating a backlight intensity of each backlight block according to a corresponding set of data;

for each group of pixels, calculating a backlight intensity corresponding to a first pixel in the group of pixels according to a backlight intensity of each effective backlight block corresponding to the first pixel and a backlight diffusion weight of the effective backlight block corresponding to the first pixel, wherein the first pixel is a pixel to which data of a first image pixel in a corresponding set of data is to be input, and, wherein the effective backlight block is a backlight block that is capable of increasing brightness of the first pixel among the N backlight blocks, and, wherein the backlight diffusion weight characterizes a degree of change in brightness of light with distance;

for a Tth group of pixels, calculating backlight intensities corresponding to second to Mth pixels in the Tth group of pixels according to the backlight intensity corresponding to the first pixel in the Tth group of pixels and the backlight intensity corresponding to the first pixel in a (T+1)th group of pixels, wherein T is an integer greater than or equal to 1, and less than or equal to (N−1); and for a Nth group of pixels, setting the backlight intensity corresponding to the first pixel in the Nth group of pixels as backlight intensities corresponding to second to Mth pixels in the Nth group of pixels.

2. The method according to claim 1, wherein before calculating the backlight intensity corresponding to the first pixel according to the backlight intensity of each effective backlight block corresponding to the first pixel and the backlight diffusion weight of the effective backlight block, the method further comprises:

performing a downsampling on an initial diffusion weight lookup table according to a preset step size to obtain a sampled diffusion weight lookup table, wherein the initial diffusion weight lookup table includes correspondences between distances from the center of each backlight block to pixels in the display panel covered by light emitted from the backlight block and corresponding backlight diffusion weights, and, wherein each distance includes a horizontal distance and a vertical distance; and obtaining a backlight diffusion weight of each effective backlight block corresponding to the first pixel according to the sampled diffusion weight lookup table.

3. The method according to claim 2, wherein obtaining the backlight diffusion weight of each effective backlight block corresponding to the first pixel according to the sampled diffusion weight lookup table, includes:

calculating a distance from the center of the effective backlight block to the first pixel;

obtaining, according to the distance from the center of the effective backlight block to the first pixel, a plurality of index coordinates corresponding to the effective backlight block, wherein the plurality of index coordinates being capable of indicating of the distance;

obtaining, according to the sampled diffusion weight lookup table and the plurality of index coordinates, a first intermediate backlight diffusion weight corresponding to each index coordinate of the effective backlight block;

calculating, according to all first intermediate backlight diffusion weights, a fourth intermediate backlight diffusion weight; and setting the fourth intermediate backlight diffusion weight as the backlight diffusion weight of the effective backlight block corresponding to the first pixel.

4. The method according to claim 3, wherein obtaining, according to the distance from the center of the effective backlight block to the first pixel, the plurality of index coordinates corresponding to the effective backlight block, includes:

calculating four distance values Index_up(i), Index_left(j), Index_down(i) and Index_right(j) according to:

$$\text{Index_left}(j) = \left\lfloor \frac{\text{dis_h}(j)}{\text{step}} \right\rfloor,$$

-continued $$\text{Index_up}(i) = \left\lfloor \frac{\text{dis_v}(i)}{\text{step}} \right\rfloor,$$

$$\text{Index_down}(i) = \left\lfloor \frac{\text{dis_v}(i)}{\text{step}} \right\rfloor + 1, \text{ and}$$

$$\text{Index_right}(j) = \left\lfloor \frac{\text{dis_h}(j)}{\text{step}} \right\rfloor + 1,$$

respectively, wherein both i and j are positive integers, and, wherein i and j indicate that the effective backlight block is an effective backlight block in row i and column j, and, wherein dis_v(i) and dis_h(j) represent a vertical distance and a horizontal distance from the center of the effective backlight block in row i and column j to the first pixel, respectively, and, wherein symbol ⌊ ⌋ represents a floor function, and, wherein step represents the preset step size; and generating, according to the four distance values, four index coordinates: (Index_up(i), Index_left(j)), (Index_up(i), Index_right(j)), (Index_down(i), Index_left(j)), and (Index_down(i), Index_right(j)).

5. The method according to claim 4, wherein calculating the fourth intermediate backlight diffusion weight includes:

calculating a second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_down(i), Index_left(j));

calculating a third intermediate backlight diffusion weight, according to the first intermediate backlight diffusion weight corresponding to the index coordinate (Index_up(i), Index_right(j)) and the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight.

6. The method according to claim 5, wherein calculating the second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_down(i), Index_left(j)), includes:

calculating the second intermediate backlight diffusion weight W_e(i, j)v according to $$\text{W_e}(i, j) = \text{W_a}(i, j) - \left\lfloor (\text{W_a}(i, j) - \text{W_c}(i, j)) \times \frac{\text{dis_v}(i)\%\text{step}}{\text{step}} + 0.5 \right\rfloor;$$

calculating the third intermediate backlight diffusion weight, according to the first intermediate backlight diffusion weight corresponding to the index coordinate (Index_up(i), Index_right(j)) and the first intermediate backlight diffusion weight corresponding to the index coordinate (Index_down(i), Index_right(j)), includes:

calculating the third intermediate backlight diffusion weight W_f(i, j) according to:

$$\text{W_f}(i, j) = \text{W_b}(i, j) - \left\lfloor (\text{W_b}(i, j) - \text{W_d}(i, j)) \times \frac{\text{dis_v}(i)\%\text{step}}{\text{step}} + 0.5 \right\rfloor,$$

wherein % represents a remainder operation, and, wherein W_a(i, j) is the first intermediate backlight diffusion weight corresponding to the index coordinate (Index_up(i), Index_left(j)), and, wherein W_b(i, j) is the first intermediate backlight diffusion weight corresponding to the index coordinate (Index_up(i), Index_right(j)), and, wherein W_c(i, j) is the first intermediate backlight diffusion weight corresponding to the index coordinate (Index_down(i), Index_left(j)), and, wherein W_d(i, j) is the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight, includes:

calculating the fourth intermediate backlight diffusion weight W(i, j) according to:

$$W(i, j) = \text{W_e}(i, j) - \left\lfloor (\text{W_e}(i, j) - \text{W_f}(i, j)) \times \frac{\text{dis_h}(j)\%\text{step}}{\text{step}} + 0.5 \right\rfloor.$$

7. The method according to claim 6, wherein calculating the backlight intensity corresponding to the first pixel according to the backlight intensity of each effective backlight block corresponding to the first pixel and the backlight diffusion weight of the effective backlight block corresponding to the first pixel, includes:

determining a number of effective backlight blocks as a product of k and k;

for a first pixel in a Xth group of pixels, calculating a backlight intensity corresponding to the first pixel in the Xth group of pixels according to $$BL_{pix(x,1)} = \sum_{i=1}^{k} \sum_{j=1}^{k} W(i, j) \times BL(i, j),$$

wherein X is an integer greater than or equal to 1 and less than or equal to N, and, wherein k is a positive integer, and, wherein BL(i, j) is a backlight intensity of an effective backlight block in row i and column j, and, wherein $BL_{pix(x,1)}$ is the backlight intensity corresponding to the first pixel in the Xth group of pixels.

8. The method according to claim 7, wherein calculating the backlight intensities corresponding to second to Mth pixels in the Tth group of pixels according to the backlight intensity corresponding to the first pixel in the Tth group of pixels and the backlight intensity corresponding to the first pixel in the (T+1)th group of pixels, includes:

calculating a backlight intensity corresponding to a Pth pixel in the Tth group of pixels according to $$BL_{pix(t,p)} = BL_{pix(t,1)} + \left\lfloor (BL_{pix(t+1,1)} - BL_{pix(t,1)}) \times \frac{P-1}{M} + 0.5 \right\rfloor;$$

wherein P is an integer greater than or equal to 2, and less than or equal to M, and, wherein $BL_{pix(t,p)}$ is the backlight intensity corresponding to the Pth pixel in the Tth group of pixels, and, wherein $BL_{pix(t,1)}$ is the backlight intensity corresponding to the first pixel in the Tth group of pixels, and, wherein $BL_{pix(t+1,1)}$ is the backlight intensity corresponding to the first pixel in the (T+1)th group of pixels.

9. The method according to claim 4, wherein calculating, according to the first intermediate backlight diffusion weight, the fourth intermediate backlight diffusion weight, includes:

calculating a second intermediate backlight diffusion weight, according to the first intermediate backlight diffusion weight corresponding to the index coordinate (Index_up(i), Index_left(j)) and the first intermediate backlight diffusion weight corresponding to the index coordinate (Index_up(i), Index_right(j));

calculating a third intermediate backlight diffusion weight, according to the first intermediate backlight diffusion weight corresponding to the index coordinate (Index_down(i), Index_left(j)) and the first intermediate backlight diffusion weight corresponding to the index coordinate (Index_down(i), Index_right(j)); and calculating the fourth intermediate backlight diffusion weight, according to the second intermediate backlight diffusion weight and the third intermediate backlight diffusion weight.

10. The method according to claim 9, wherein calculating the second intermediate backlight diffusion weight, according to the first intermediate backlight diffusion weight corresponding to an index coordinate (Index_up(i), Index_left(j)) and the first intermediate backlight diffusion weight corresponding to an index coordinate (Index_up(i), Index_right(j)), includes:

calculating the second intermediate backlight diffusion weight W_e(i, j) according to $$W_e(i, j) = W_a(i, j) - \left\lfloor (W_a(i, j) - W_b(i, j)) \times \frac{dis_h(j)\%step}{step} + 0.5 \right\rfloor;$$

calculating the third intermediate backlight diffusion weight, according to the first intermediate backlight diffusion weight corresponding to an index coordinate (Index_down(i), Index_left(j)) and the first intermediate backlight diffusion weight corresponding to an index coordinate (Index_down(i), Index_right(j)), includes:

calculating the third intermediate backlight diffusion weight W_f(i, j) according to $$W_f(i, j) = W_c(i, j) - \left\lfloor (W_c(i, j) - W_d(i, j)) \times \frac{dis_h(j)\%step}{step} + 0.5 \right\rfloor;$$

and calculating the fourth intermediate backlight diffusion weigh, according to the second intermediate backlight diffusion weight and the third intermediate backlight diffusion weight, t, includes:

calculating the fourth intermediate backlight diffusion weight W(i, j) according to $$W(i, j) = W_e(i, j) - \left\lfloor (W_e(i, j) - W_f(i, j)) \times \frac{dis_v(i)\%step}{step} + 0.5 \right\rfloor.$$

11. The method according to claim 2, wherein after calculating the backlight intensity corresponding to the first pixel according to the backlight intensity of each effective backlight block corresponding to the first pixel and the backlight diffusion weight of the effective backlight block corresponding to the first pixel, the method further comprises:

reading a reference backlight diffusion weight of each effective backlight block corresponding to the first pixel from the initial diffusion weight lookup table;

calculating a reference backlight intensity corresponding to the first pixel according to the backlight intensity of each effective backlight block and the reference backlight diffusion weight of the effective backlight block corresponding to the first pixel;

determining whether a difference between the reference backlight intensity corresponding to the first pixel and the backlight intensity corresponding to the first pixel is less than or equal to a preset threshold; and in response to determining that the difference is not less than or equal to the preset threshold, adjusting the preset step size until the difference between the reference backlight intensity corresponding to the first pixel and the backlight intensity corresponding to the first pixel is less than or equal to the preset threshold.

12. A non-transitory computer readable storage medium storing computer programs that, when executed by a processor, perform the method for obtaining the backlight intensity according to claim 1.

13. A display device, comprising:

a display panel;

a backlight module, a memory storing computer programs; and a processor configured to execute the computer programs to perform the method for obtaining the backlight intensity according to claim 1.

14. A method for obtaining a compensation value, the method comprising:

obtaining a backlight intensity corresponding to each pixel by using the method for obtaining the backlight intensity according to claim 1;

performing a stratified downsampling on an initial compensation weight lookup table to obtain a sampled compensation weight lookup table, wherein the initial compensation weight lookup table includes correspondences among a plurality of initial index values, a plurality of backlight intensities and a plurality of compensation weights, and, wherein the initial index values are equal to their corresponding backlight intensities;

obtaining a compensation weight corresponding to each pixel according to the sampled compensation weight lookup table; and calculating a compensation value corresponding to each pixel, according to the compensation weight corresponding to the pixel and three primary color components in data of an image pixel corresponding to the pixel.

15. The method according to claim 14, wherein performing the stratified downsampling on the initial compensation weight lookup table to obtain the sampled compensation weight lookup table includes:

obtaining correspondences between a plurality of sampled index values and the plurality of initial index values according to $$\begin{cases} 0 \le Y \le 27,\ F(Y) = Y \\ 27 < Y \le 34,\ F(Y) = 4 \times (Y - 27) + 27 \\ 34 < Y \le 59,\ F(Y) = 8 \times (Y - 34) + 55 \end{cases},$$

wherein F(Y) is the initial index value and Y is the sampled index value; and performing a stratified downsampling on the initial compensation weight lookup table according to the correspondences between the plurality of sampled index values and the plurality of initial index values to obtain the sampled compensation weight lookup table.

16. The method according to claim 15, wherein obtaining the compensation weight corresponding to each pixel according to the sampled diffusion weight lookup table, includes:

for the backlight intensity $BL_{pix}$ corresponding to the pixel:

determining which range the $BL_{pix}$ belongs to;

in response to determining that $BL_{pix}$ is greater than or equal to 0 and less than or equal to 27:

setting Y as $BL_{pix}$, and calculating the compensation weight $W_BL_{pix}$ corresponding to the pixel according to $W_BL_{pix}=W(Y)$, wherein W(Y) is the compensation weight corresponding to the sampled index value Y in the sampled compensation weight lookup table;

in response to determining that the $BL_{pix}$ is greater than 27 and less than or equal to 55:

setting Y and Mod as $$Y = 27 + \left\lfloor \frac{(BL_{pix} - 27)}{4} \right\rfloor$$

and $Mod=(BL_{pix}-27)\%4$ respectively, and calculating the compensation weight $W_BL_{pix}$ corresponding to the pixel according to WL=W(Y), WR=W(Y+1), $$W_BL_{pix} = WL - \left\lfloor \frac{(WL - WR) \times \mathrm{Mod}}{4} + 0.5 \right\rfloor;$$

in response to determining that the $BL_{pix}$ is greater than 55 and less than or equal to 255:

setting Y and Mod as $$Y = 34 + \left\lfloor \frac{(BL_{pix} - 55)}{8} \right\rfloor$$

and $Mod=(BL_{pix}-55)\%8$ respectively, and calculating the compensation weight $W_BL_{pix}$ corresponding to the pixel according to WL=W(Y), WR=W(Y+1), $$W_BL_{pix} = WL - \left\lfloor \frac{(WL - WR) \times \mathrm{Mod}}{8} + 0.5 \right\rfloor,$$

wherein % represents a remainder operation, symbol H represents a floor operation; W(Y+1) is a compensation weight corresponding to a sampled index value (Y+1) in the sampled compensation weight lookup table, and $W_BL_{pix}$ is a compensation weight corresponding to a pixel having a backlight intensity of $BL_{pix}$.

17. The method according to claim 16, wherein calculating the compensation value corresponding to each pixel according to the compensation weight corresponding to the pixel and the three primary color components in data of an image pixel corresponding to the pixel, includes:

for each pixel:

calculating a product of a red brightness value R and the compensation weight $W_BL_{pix}$ corresponding to the pixel as a red brightness compensation value R', calculating a product of a green brightness value G and the compensation weight $W_BL_{pix}$ corresponding to the pixel as a green brightness compensation value G', and calculating a product of a blue brightness value B and the compensation weight $W_BL_{pix}$ corresponding to the pixel as a blue brightness compensation value B'.

18. A non-transitory computer readable storage medium storing computer programs that, when executed by a processor, perform the method for obtaining the compensation value of the backlight according to claim 14.

19. A display device, comprising:

a display panel, a backlight module, a memory storing computer programs; and a processor configured to execute the computer programs to perform the method for obtaining the compensation value of the backlight according to claim 14.

* * * * *